US009073713B2

(12) United States Patent
Ono et al.

(10) Patent No.: US 9,073,713 B2
(45) Date of Patent: Jul. 7, 2015

(54) TRANSPORT DEVICE, TRANSPORT METHOD, IMAGE FORMING APPARATUS, AND IMAGE FORMING METHOD FOR SHEET TRANSPORT CONTROL USING SHEET LENGTH

(71) Applicant: FUJI XEROX CO., LTD., Minato-ku, Tokyo (JP)

(72) Inventors: Ayumu Ono, Kanagawa (JP); Satoshi Kubota, Kanagawa (JP); Tomohiro Yamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 43 days.

(21) Appl. No.: 13/868,682

(22) Filed: Apr. 23, 2013

(65) Prior Publication Data

US 2014/0153993 A1 Jun. 5, 2014

(30) Foreign Application Priority Data

Nov. 30, 2012 (JP) ..... 2012-263854

(51) Int. Cl.

| | |
|---|---|
| ***B41J 29/38*** | (2006.01) |
| ***B65H 35/04*** | (2006.01) |
| ***B41J 11/70*** | (2006.01) |
| ***B65H 7/06*** | (2006.01) |
| ***B41J 11/66*** | (2006.01) |
| ***B41J 11/42*** | (2006.01) |

(52) U.S. Cl.

CPC ..... *B65H 7/06* (2013.01); *B65H 2511/112* (2013.01); *B41J 11/663* (2013.01); *B41J 11/42* (2013.01); *B41J 11/70* (2013.01); *B65H 35/04* (2013.01); *B65H 2511/11* (2013.01); *B65H 2511/22* (2013.01); *B65H 2513/10* (2013.01); *B65H 2801/27* (2013.01)

(58) Field of Classification Search

CPC ..... B41J 1/663; B65H 35/04
USPC ..... 400/76, 621; 83/367, 358, 359
See application file for complete search history.

(56) References Cited

U.S. PATENT DOCUMENTS

| | | | | | |
|---|---|---|---|---|---|
| 3,639,053 | A * | 2/1972 | Spear, Jr. | ..... | 399/385 |
| 5,701,573 | A * | 12/1997 | Yoshiuchi et al. | ..... | 399/384 |
| 5,708,345 | A * | 1/1998 | Kramer et al. | ..... | 318/696 |
| 5,737,988 | A * | 4/1998 | Krupica et al. | ..... | 83/367 |
| 6,229,983 | B1 * | 5/2001 | Sawada | ..... | 399/385 |
| 7,601,238 | B2 * | 10/2009 | Takahashi | ..... | 156/270 |
| 2011/0211031 | A1 * | 9/2011 | Satoh et al. | ..... | 347/104 |

FOREIGN PATENT DOCUMENTS

| | | | | | |
|---|---|---|---|---|---|
| JP | 03274175 | A * | 12/1991 | ..... | B41J 15/04 |
| JP | 05301395 | A * | 11/1993 | ..... | B41J 11/42 |
| JP | 08337023 | A * | 12/1996 | ..... | B41J 11/66 |
| JP | 2003-211752 | A | 7/2003 | | |
| JP | 2009220498 | A * | 10/2009 | ..... | B41J 11/42 |

* cited by examiner

*Primary Examiner* — Daniel J Colilla
(74) *Attorney, Agent, or Firm* — Sughrue Mion, PLLC

(57) ABSTRACT

A transport device includes a transport unit that transports a paper sheet, a cutter unit that cuts the paper sheet, and a controller that, when transport of the paper sheet in the vicinity of the cutter unit is to be halted, controls the transport unit so that the transport unit transports the paper sheet by a longer travel when a specified length of the paper sheet is shorter than a threshold length than when the specified length of the paper sheet is longer than the threshold length.

11 Claims, 21 Drawing Sheets

| STEP | PULSE COUNT | TIME |
|---|---|---|
| 1 | 4 | 10 ms |
| 2 | 6 | 10 ms |
| 3 | 8 | 10 ms |
| 4 | 10 | 10 ms |
| 5 | 12 | – |

| STEP | PULSE COUNT | TIME |
|---|---|---|
| 1 | 12 | – |
| 2 | 10 | 20 ms |
| 3 | 8 | 20 ms |
| 4 | 6 | 20 ms |
| 5 | 4 | 20 ms |

TRANSPORT DEVICE, TRANSPORT METHOD, IMAGE FORMING APPARATUS, AND IMAGE FORMING METHOD FOR SHEET TRANSPORT CONTROL USING SHEET LENGTH

CROSS-REFERENCE TO RELATED APPLICATIONS

This application is based on and claims priority under 35 USC 119 from Japanese Patent Application No. 2012-263854 filed Nov. 30, 2012.

BACKGROUND

Technical Field

The present invention relates to a transport device, a transport method, an image forming apparatus, and an image forming method.

SUMMARY

According to an aspect of the invention, there is provided a transport device including a transport unit that transports a paper sheet, a cutter unit that cuts the paper sheet, and a controller that, when transport of the paper sheet in the vicinity of the cutter unit is to be halted, controls the transport unit so that the transport unit transports the paper sheet by a longer travel when a specified length of the paper sheet is shorter than a threshold length than when the specified length of the paper sheet is longer than the threshold length.

BRIEF DESCRIPTION OF THE DRAWINGS

Exemplary embodiments of the present invention will be described in detail based on the following figures, wherein:

FIGS. 8-2A and 8-2B illustrate an operation of a cutter unit and a paper sheet in contrast to a stationary period caused by a standby state of FIGS. 8-1A and 8-1B;

FIGS. 12-1A and 12-1B are timing diagrams illustrating the operations of the first and third motors in a fourth transport mode;

FIGS. 12-2A and 12-2B illustrate the operation of the cutter unit and the paper sheet in contrast to the stationary period for the standby state of FIGS. 12-1A and 12-1B;

FIGS. 15-1A and 15-1B are timing diagrams illustrating the operation of the first motor in a fifth transport mode;

FIGS. 15-2A and 15-2B illustrate the operation of the cutter unit and the paper sheet in contrast to the stationary period for the standby state of FIGS. 15-1A and 15-1B;

FIGS. 16-1A through 16-1C are timing diagrams illustrating the operations of the first and third motors in a sixth transport mode;

FIGS. 16-2A through 16-2C illustrate the operation of the cutter unit and the paper sheet in contrast to the stationary period for the standby state of FIGS. 16-1A through 16-1C.

DETAILED DESCRIPTION

In an exemplary embodiment, a roll of paper sheet P is transported and then cut to each piece of paper sheet P having a predetermined length by a cutter unit. While the paper sheet P is transported, transport of the paper sheet P may be temporarily halted before a cut line of the paper sheet P reaches a cutter unit, for example, when a leading end of the paper sheet P reaches a standby position where the leading end of the paper sheet P stays standby.

The cut line of the halted paper sheet P may be too close to the cutter unit. In such a case, even if the paper sheet P is halted immediately after the paper sheet P resumes motion, the cut line may be difficult to halt at the cutter unit, and the paper sheet P may halt with the cut line passing by the cutter unit. In other words, the length of a cut paper sheet P can be longer than a predetermined length.

In a control process of the exemplary embodiment, when the cut line of the paper sheet P is within a close range to the cutter unit, the cut line of the paper sheet P is directly being transported to the cutter unit without being halted before reaching the cutter unit.

Exemplary embodiments of the present invention are described in detail with reference to the drawings.

Figure 1:
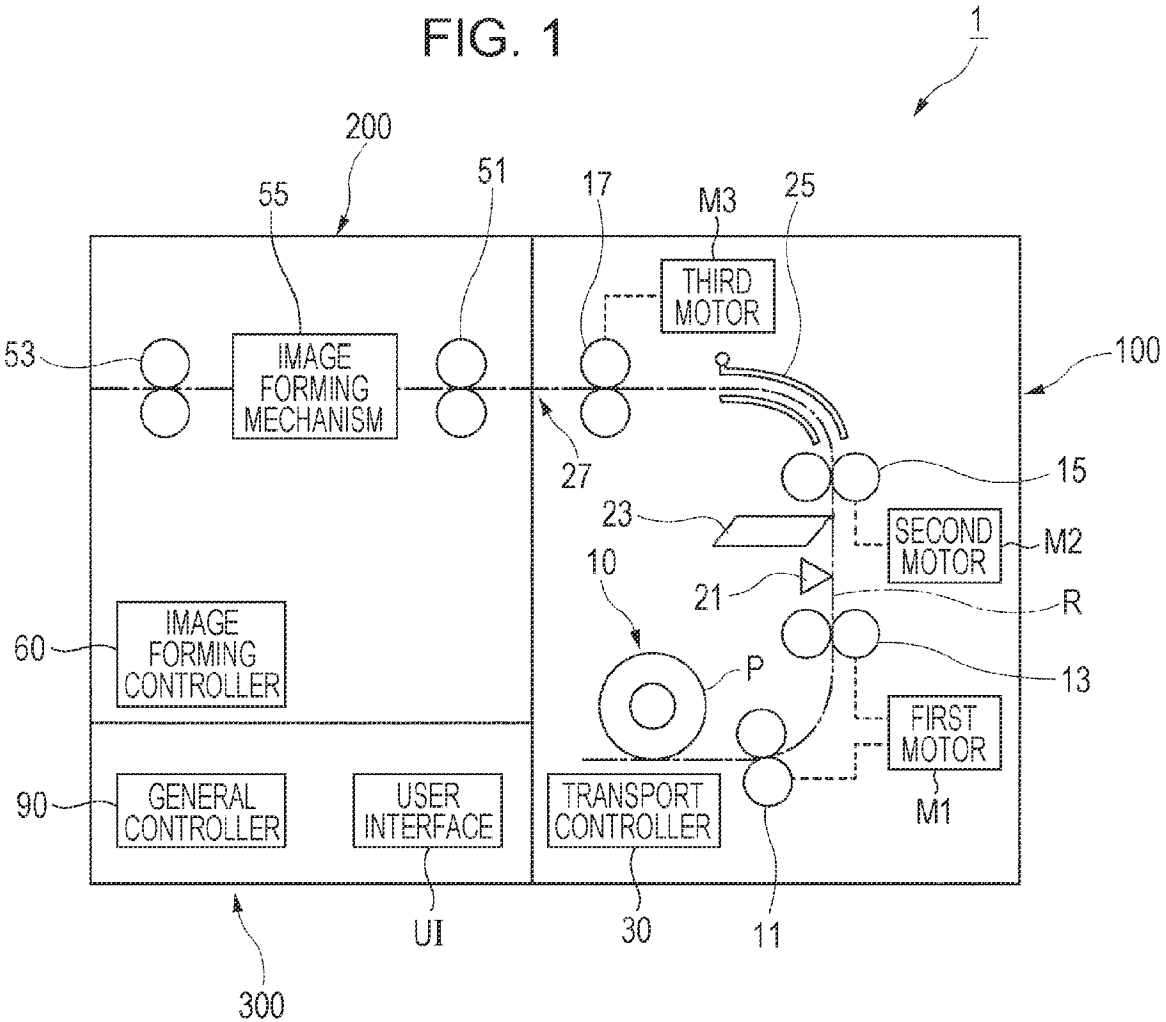
FIG. 1 generally illustrates an image forming system of an exemplary embodiment.

FIG. 1 generally illustrates an image forming system 1 of an exemplary embodiment.

In response to an instruction, the image forming system 1 forms an image on a roll of paper sheet P that is to be cut. The image forming system 1 includes a paper feeder device 100 that supplies the paper sheet P, an image forming apparatus 200 that forms an image on the paper sheet P supplied from the paper feeder device 100, and a control device 300 that generally controls the image forming system 1. The image forming system 1 also includes a paper transport passage R that allows the paper sheet P to be transported therethrough from the paper feeder device 100 to the image forming apparatus 200.

The paper feeder device (transport device) 100 includes a feeder unit (supply unit) 10 that is loaded with the roll of paper sheet P and extends from an upstream side to a downstream side in a transport direction of the paper sheet P, first rollers 11, second rollers 13, third rollers 15, and fourth rollers 17, each roller pair rotating to transport the paper sheet P, and a discharge port 27 that discharges the paper sheet P toward the image forming apparatus 200.

As illustrated in FIG. 1, the paper feeder device 100 further includes a cutter unit of the exemplary embodiment between the second rollers 13 and the third rollers 15 in the paper transport passage R. The cutter unit includes a sensor 21 that detects a pass of the paper sheet P and a cutter 23 that cuts the paper sheet P by a sheet length instructed by an instruction unit. The cutter 23 may be of any type. For example, the cutter 23 may be guillotine type in which a cutter blade moves vertically with respect to the paper sheet P, or a rotary cutter type in which a cutter blade moves in the direction of width of the paper sheet P. The paper feeder device 100 also includes a movable transport path 25 that allows the paper sheet P to curve between the third rollers 15 and the fourth rollers 17 in the paper transport passage R.

The paper feeder device 100 further includes a first motor M1 that rotates the first rollers 11 and the second rollers 13, a second motor M2 that rotates the third rollers 15, and a third motor M3 that rotates the fourth rollers 17. The first motor M1 through the third motor M3 are stepping motors.

The paper feeder device 100 further includes a transport controller 30 that controls elements of the paper feeder device 100.

The first rollers 11, the first motor M1, the fourth rollers 17, and the third motor M3 are an example of the transport unit. The first motor M1 is part of a first transport section and a third transport section. The third motor M3 is an example of a second transport section. The transport controller 30 is an example of a controller in the exemplary embodiment.

The image forming apparatus 200 includes input rollers 51, an image forming mechanism 55, and discharge rollers 53. The input rollers 51, when rotating, receive the paper sheet P discharged through the discharge port 27 of the paper feeder device 100. The image forming mechanism 55 of the exemplary embodiment forms an image on the paper sheet P transported by the input rollers 51. The discharge rollers 53 discharges from the image forming apparatus 200 the paper sheet P having the image formed thereon by the image forming mechanism 55.

The image forming apparatus 200 includes an image forming controller 60 that controls elements of the image forming apparatus 200.

The image forming mechanism 55 forms an image through an ink-jet method. Optionally, the image forming mechanism 55 may form an image through an electrophotographic method or any other method.

The control device 300 includes a general controller 90 that controls elements of the image forming system 1. The control device 300 receives instruction information from a user and in response to the instruction information, outputs instruction information to the paper feeder device 100 or any other device.

As illustrated in FIG. 1, the paper feeder device 100, the image forming apparatus 200, and the control device 300 are separate entities. When the image forming apparatus 200 completes image forming, the image forming system 1 outputs a paper feed instruction to feed a next paper sheet P. If the image forming is not yet complete, or if the image forming apparatus 200 is not yet ready to receive the paper sheet P, the paper feeder device 100 keeps the next paper sheet P on standby for the paper feed instruction. If a paper feed instruction is provided, the next paper sheet P is transported from the paper feeder device 100 to the image forming apparatus 200 without being on standby.

As illustrated in FIG. 1, the control device 300 includes the general controller 90. Optionally, the function of the general controller 90 may be implemented by the transport controller 30 in the paper feeder device 100 or the image forming controller 60 in the image forming apparatus 200.

Figure 2:
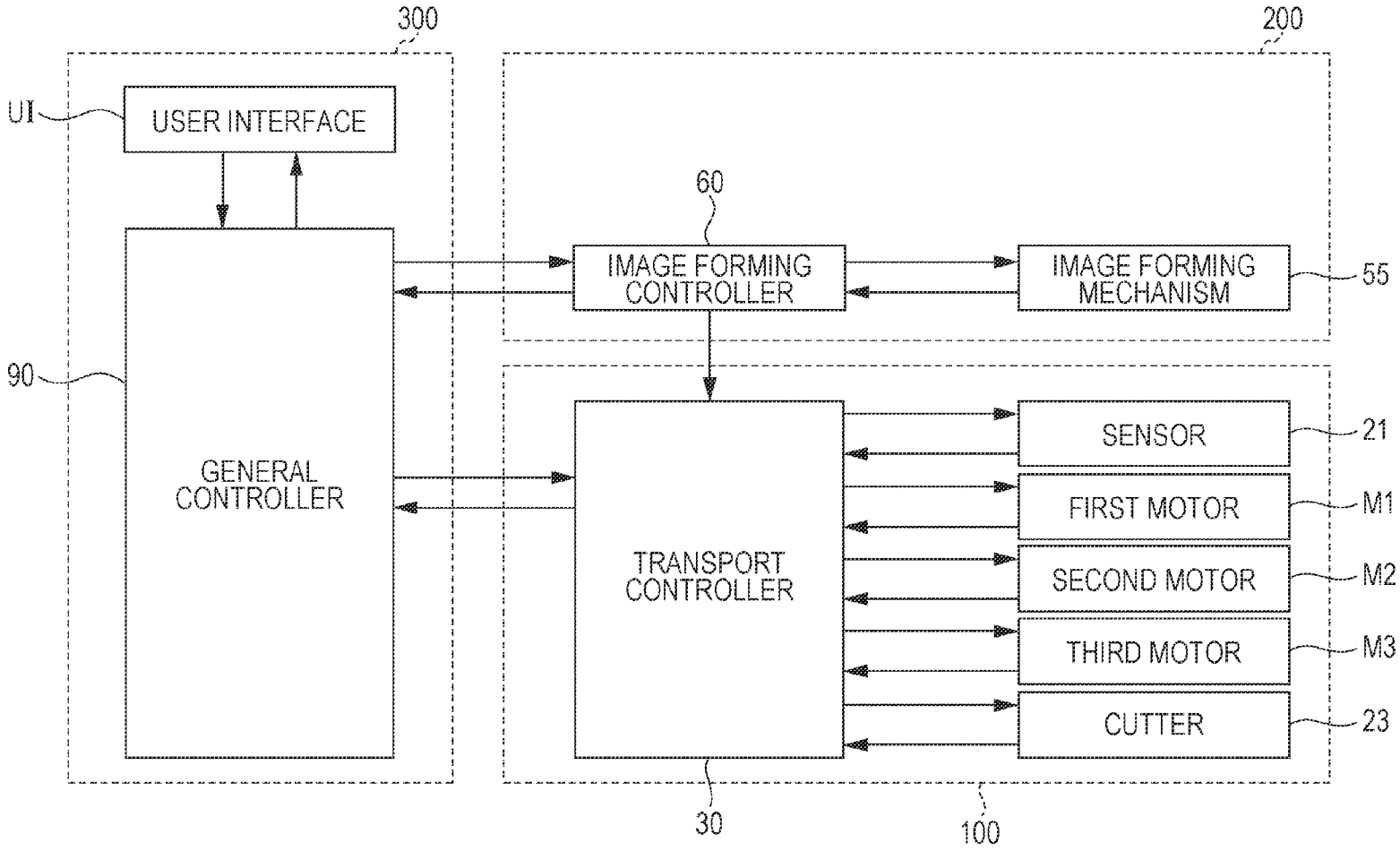
FIG. 2 is a function block diagram illustrating a general controller.

FIG. 2 is a function block diagram of the general controller 90.

The general controller 90 of the exemplary embodiment receives image forming data as a data signal related to image forming from a user interface UI or a personal computer that has received the instruction information from the user. The general controller 90 obtains, from the input image forming data, information that is used to instruct an image to be formed, for example, a length and width of the paper sheet P. For example, the paper sheet length may be set in steps of 1 mm, and any sheet size including sheet size A may be set.

The general controller 90 receives, via the transport controller 30, a detected signal of the paper sheet P from the sensor 21 and output pulse counts OTP (as described below) respectively from the first motor M1 through the third motor M3. The general controller 90 receives instruction information or transport status of the paper sheet P (normal or faulty state).

The general controller 90 also receives from the image forming controller 60 information specifying a file format and a procedure of a data signal.

The general controller 90 outputs to the transport controller 30 information related to the paper sheet length and start of the transport of the paper sheet P. The general controller 90 also outputs control signals respectively to the first motor M1 through the third motor M3, and the cutter 23 via the transport controller 30.

The general controller 90 outputs a control signal to the image forming mechanism 55 via the image forming controller 60. The general controller 90 further outputs to the image forming controller 60 the data signal in accordance with the data format and procedure specified by the image forming controller 60.

The transport controller 30 receives a control signal from the image forming controller 60. The transport controller 30 further receives from the image forming controller 60 an instruction (I/O) to receive the paper sheet P at the image forming mechanism 55 and a signal (I/O) to end the image forming or the transport of the paper sheet P. The paper feeder device 100 of the exemplary embodiment feeds the paper sheet P to the image forming apparatus 200 in response to a feed instruction to receive a next paper sheet P from the image forming controller 60.

The general controller 90, the transport controller 30, and the image forming controller 60 are implemented when respective central processing units (CPUs) read predetermined programs onto random-access memories (RAMs) and execute the read programs.

A movable transport path 25 included in the paper feeder device 100 is described below.

Figure 3B:
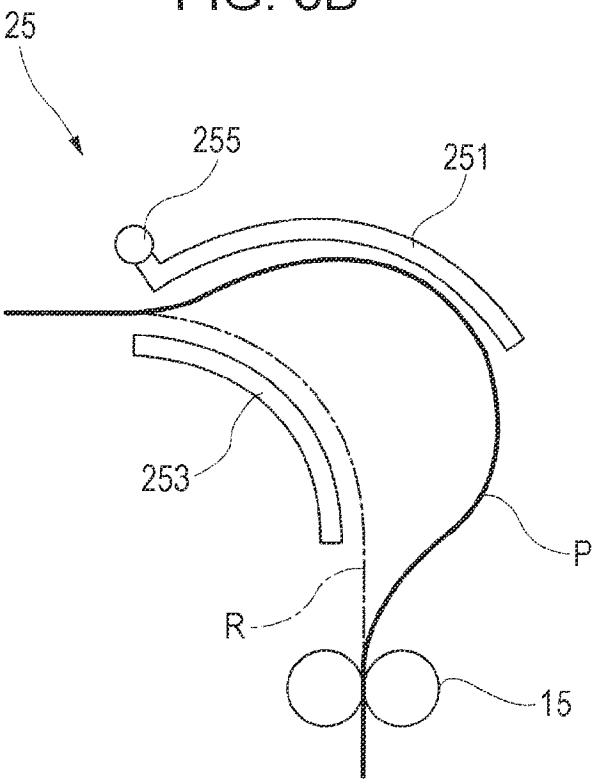
FIGS. 3A and 3B generally illustrate a movable transport path.
Figure 3A:
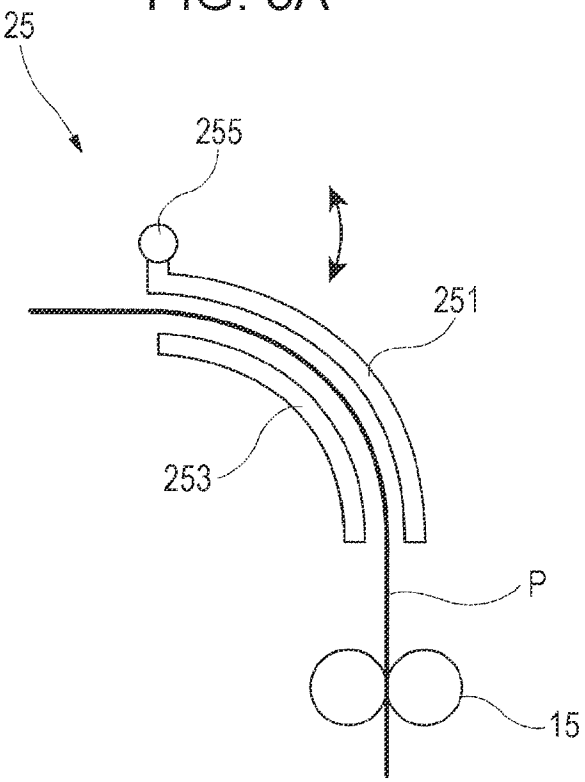

FIGS. 3A and 3B generally illustrate the movable transport path 25.

As illustrated in FIG. 3A, the movable transport path (accommodating unit) 25 includes plate members arranged along the paper transport passage R. More specifically, the movable transport path 25 include a movable plate 251 and a fixed plate 253 mutually facing each other with the paper transport passage R interposed therebetween.

The movable plate 251 includes a rotary shaft 255 at one edge thereof across the transport direction of the paper sheet P. With the movable plate 251 and the rotary shaft 255 pivotally rotated about an axis of the rotary shaft 255, the edge of the movable plate 251 opposed to the rotary shaft 255 is spaced apart from or close to the paper transport passage R. The fixed plate 253 is fixed with respect to the paper transport passage R.

As illustrated in FIG. 3B, the paper sheet P transported may curve or loop depending on a difference between a transport speed of the paper sheet P at the third rollers 15 and a transport speed of the paper sheet P at the fourth rollers 17 (see FIG. 1). The movable plate 251 of the movable transport path 25 pivots on the rotary shaft 255 in response to the curving of the paper sheet P in a manner such that the paper transport passage R is widened. At least part of a curving portion of the paper sheet P is present in space formed in the movable transport path 25.

In the exemplary embodiment, the movable transport path 25 covers the curved portion, thereby controlling paper jamming that can be caused if the curved portion of the paper sheet P touches another element.

Figure 4B:
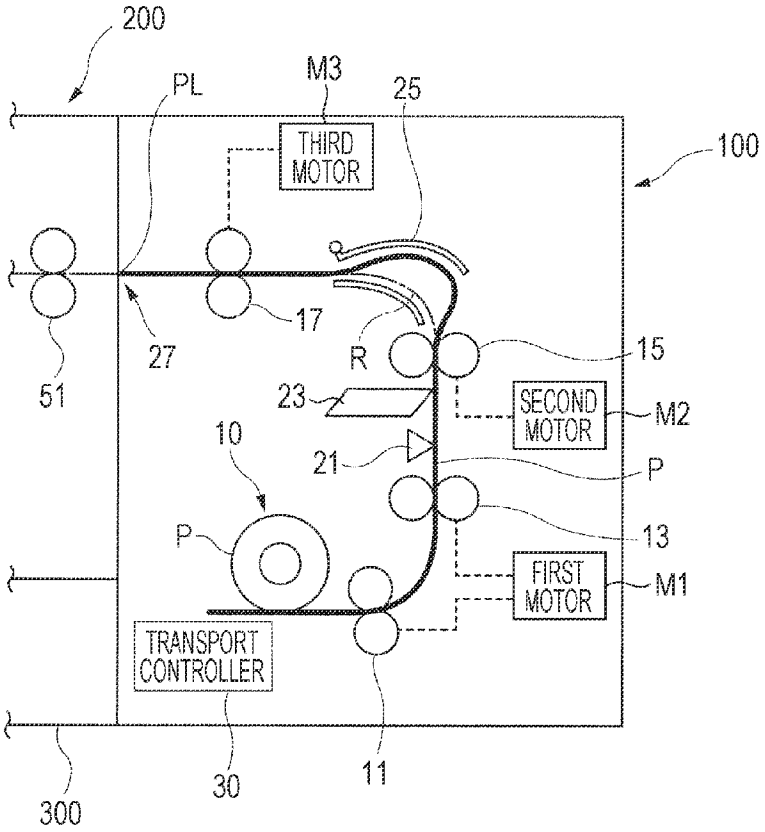
FIGS. 4A and 4B illustrate an operation of a paper feeder device.
Figure 4A:
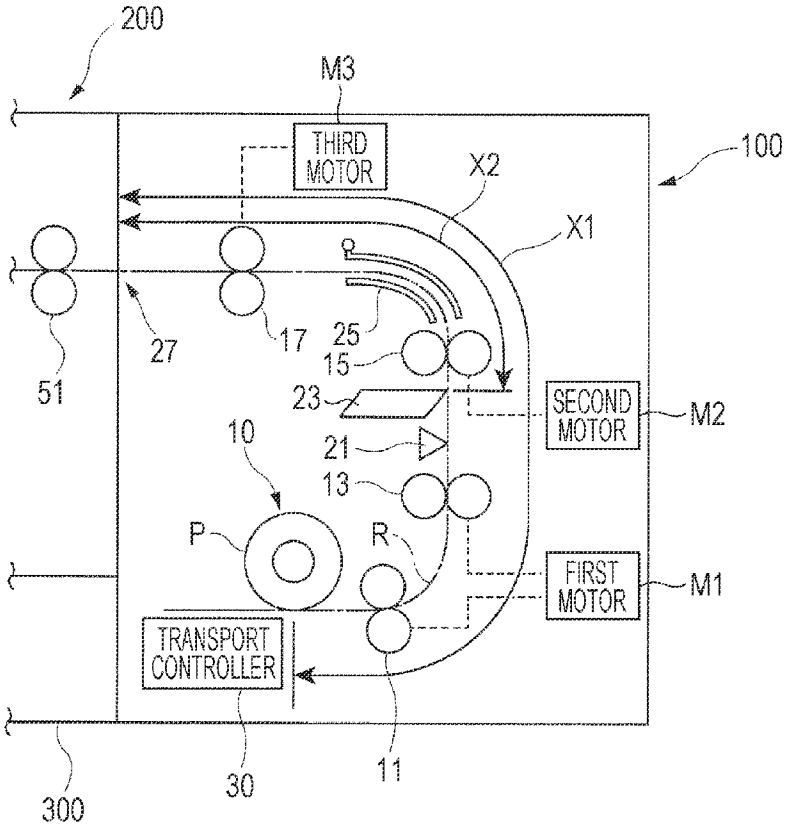

An operation of the image forming system 1 is described with reference to FIGS. 1 through 4A and 4B. FIGS. 4A and 4B illustrate the operation of the paper feeder device 100.

The general controller 90 receives image forming data via the user interface UI or personal computer in response to an input operation of a user. Upon receiving the image forming data, the general controller 90 transfers to the image forming controller 60 the image forming data in a predetermined file format. In parallel with the transfer of the image forming data to the image forming controller 60, the general controller 90 outputs instruction information obtained from the image forming data to the transport controller 30.

Upon receiving the transferred image forming data and completing the preparation for image forming, the image forming controller 60 outputs to the transport controller 30 an instruction information signal (paper feed signal) to feed the paper sheet P. When the transport controller 30 receives the paper feed signal from the image forming controller 60, the paper feeder device 100 starts feeding the paper sheet P to the image forming apparatus 200.

The image forming apparatus 200 forms an image on the paper sheet P, and discharges the paper sheet P having the image formed thereon to the outside. The image forming controller 60 outputs to the transport controller 30 a signal indicating the end of the image forming and the paper transport. Upon receiving the signal, the transport controller 30 outputs a signal indicating a job end to the general controller 90. If an image is to be formed on a next paper sheet P, the general controller 90 outputs instruction information.

FIG. 4A illustrates distances along the paper transport passage R in the paper feeder device 100. Let X1 represent a distance from the feeder unit 10 to the discharge port 27, and X2 represent a distance from the cutter 23 to the discharge port 27. The feeder unit 10 and the cutter 23 are spaced apart from each other in the paper transport passage R. If the transport controller 30 starts transporting the paper sheet P after the image forming controller 60 outputs the instruction information signal to feed the paper sheet P, it takes time to start to feed the paper sheet P to the image forming apparatus 200.

The paper feeder device 100 of the exemplary embodiment expedites the feed timing of the paper sheet P to the image forming apparatus 200. Before receiving the signal from the image forming controller 60 (see FIG. 1), the paper feeder device 100 causes the feeder unit 10 to start feeding the paper sheet P, and to transport the paper sheet P until a leading end PL of the paper sheet P in the transport direction reaches the discharge port 27, and then to wait on standby as illustrated in FIG. 4B. The third motor M3 that rotates the fourth rollers 17 stops rotating when the leading end PL reaches the discharge port 27.

The operation of each element in the paper feeder device 100 is specifically described. Before receiving the paper feed signal from the image forming controller 60 (FIG. 1), the transport controller 30 starts transporting the paper sheet P by driving the first motor M1. If the leading end PL of the paper sheet P is placed at the cutter 23, the second motor M2 is also driven. Upon receiving from the sensor 21 a detection signal of the transported paper sheet P, the transport controller 30 causes the second motor M2 and the third motor M3 to start rotating at the timings when the leading end PL of the paper sheet P is transported.

The transport controller 30 causes the third motor M3 to stop rotating at the timing when the leading end PL of the paper sheet P reaches the vicinity of the discharge port 27. The transport controller 30 causes the first motor M1 and the second motor M2 to stop rotating at the timing when a transport distance of the paper sheet P reaches a paper sheet length specified by information from the general controller 90 (as described in detail below). In this way, an ideal cut line on the trailing end of the paper sheet P where the paper sheet P is to be cut is aligned with the cutter 23.

If the transport controller 30 receives the paper feed signal from the image forming controller 60 with the leading end PL of the paper sheet P at the discharge port 27, a period of time from when the paper feeder device 100 receives the paper feed signal to when the paper feeding to the image forming apparatus 200 starts is shortened.

As illustrated in FIG. 4A, the cutter 23 cuts the paper sheet P after the transport controller 30 receives the paper feed signal from the image forming controller 60. The paper sheet P having a paper sheet length shorter than distance X2 is cut in advance before the paper feed signal is received.

While the image forming apparatus 200 is forming an image on a preceding paper sheet P in the example of FIGS. 4A and 4B, the image forming controller 60 outputs the paper feed signal only after the preceding paper sheet P has been discharged from the image forming mechanism 55. Since time for the image forming may be different depending on the paper sheet length, an amount of data to be printed, and other factors, there are cases when the timing may be difficult to predict. The paper sheet P is transported to a standby position in advance and remains on standby. This arrangement shortens time taken from when the preceding paper sheet P passes through the image forming mechanism 55 to when a next paper sheet P is fed to the image forming mechanism 55. In other words, the paper sheet spacing as a distance between the paper sheets P is narrowed.

The paper feeder device 100 of FIG. 4B allows the paper sheet P to be curved (looped) in the movable transport path 25. In this way, a difference is allowed between a transport speed on the second rollers 13 and third rollers 15 and a transport speed on the fourth rollers 17 with the movable transport path 25 arranged therebetween in the transport passage of the paper sheet P.

More specifically, in the exemplary embodiment, the cutter 23 may cut the paper sheet P at the trailing end thereof with the paper sheet P halted by the second rollers 13 and the third rollers 15 while the leading end PL of the paper sheet P is transported by the fourth rollers 17 toward the image forming apparatus 200. Furthermore, if the formed curve falls within a range that absorbs a transport speed difference of the paper sheet P, the leading end PL of the paper sheet P can be transported toward the image forming apparatus 200 regardless of whether the paper sheet P is halted in a cutting operation of the cutter 23. A time interval (paper sheet spacing) of the paper sheets P to be fed to the image forming mechanism 55 is thus reduced.

An operation of the first motor M1 is described below.

Figures 5A, 5B, 5C:
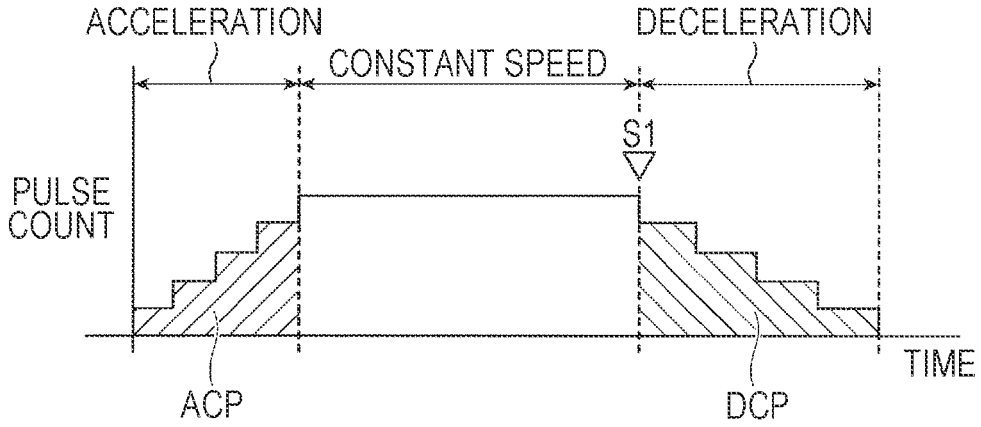
FIGS. 5A through 5C illustrate an operation of a first motor.

FIGS. 5A through 5C illustrate the operation of the first motor M1. More specifically, FIG. 5A illustrates a relationship between an output pulse count OTP of the first motor M1 and time. FIG. 5B illustrates a change in the pulse count at each step (unit time of 10 ms) during an acceleration period of the first motor M1. FIG. 5C illustrates a change in the pulse count at each step (unit time of 20 ms) during a deceleration period of the first motor M1. The "pulse count" in FIGS. 5B and 5C represents the number of pulses output by the first motor M1 at each step.

The first motor M1 is a stepping motor as described above. For the first motor M1 to rotate at a predetermined (constant) speed, the first motor M1 starts up from a halt state, accelerates in an acceleration period, and then reaches the constant speed. After the constant speed is maintained (during a constant speed period), the first motor M1 decelerates and then comes to a halt.

Let ACP represent an acceleration pulse count indicating the number of pulses used during the acceleration period from a halt state to the constant speed state of the first motor M1 (see FIG. 5A). Let DCP represent the number of pulses used during the deceleration period from the constant speed state to the halt state of the first motor M1 (see FIG. 5A). Let ADP represent an acceleration and deceleration pulse count which is the number of pulses used in the acceleration period and the deceleration period, in other words, the sum of the acceleration pulse count ACP and the deceleration pulse count DCP.

The acceleration pulse count ACP, the deceleration pulse count DCP, and the acceleration and deceleration pulse count ADP are unique to the first motor M1, and are definitely determined by determining the constant speed. Information of the acceleration pulse count ACP, the deceleration pulse count DCP, and the acceleration and deceleration pulse count ADP is transmitted from the first motor M1 to the transport controller 30 at the setup of the image forming system 1.

Let STP represents a stop pulse count. The stop pulse count STP is an output pulse count OTP of the first motor M1 that is for the first motor M1 to be halted and is determined in accordance with the specified paper length. Let DSP represent a deceleration start pulse count. The deceleration start pulse count DSP is an output pulse count OTP of the first motor M1 that is for the first motor M1 to start decelerating in order to cause the first motor M1 rotating at the constant speed to halt with the stop pulse count STP.

The first motor M1 rotates and transports the paper sheet P in response to a control signal from the transport controller 30. The operation of the transport controller 30 and the first motor M1 is described below.

Upon obtaining the instruction information from the general controller 90, the transport controller 30 calculates the stop pulse count STP in response to information of the specified paper sheet length contained in the instruction information. The transport controller 30 determines the deceleration start pulse count DSP from a difference between the calculated stop pulse count STP and the deceleration pulse count DCP.

Upon receiving the paper feed signal, the transport controller 30 starts transporting the paper sheet P by driving the first motor M1 and counting (monitoring) the output pulse count OTP of the first motor M1. When the output pulse count OTP monitored reaches the deceleration start pulse count DSP, the transport controller 30 starts decelerating the first motor M1. The transport of the paper sheet P halts with the ideal point of the paper sheet P at the cutter 23. The output pulse count OTP of the first motor M1 is then the stop pulse count STP.

In an operation example discussed below, the paper sheet P is cut to a paper sheet having a specified length of 1800 mm, and the first motor M1 is accelerated in accordance with the change in the pulse count of FIG. 5B and is decelerated in accordance with the change in the pulse count of FIG. 5C.

If a transport distance of the paper sheet P by one pulse of the first motor M1 is 10 mm, the first motor M1 is to be halted when the output pulse count OTP of the first motor M1 becomes 180 pulses in order to transport the paper sheet P by the specified paper sheet length. As illustrated 7in FIG. 5C, the first motor M1 is to be supplied with 56 pulses as the deceleration pulse count DCP. The deceleration start timing of the first motor M1 (the timing of the deceleration start pulse count DSP as denoted by symbol S1 in FIG. 5A) is the timing when 124 pulses (=180 pulses−56 pulses) have been output since the start of counting the output pulse count OTP. In other words, the deceleration start timing is determined in view of the length of the paper sheet P that has been transported until the halt of the first motor M1.

The first motor M1 might halt at a position different from an intended position (specified by the stop pulse count STP), depending on the relationship with the deceleration start timing. This is specifically described below.

Figure 6A:
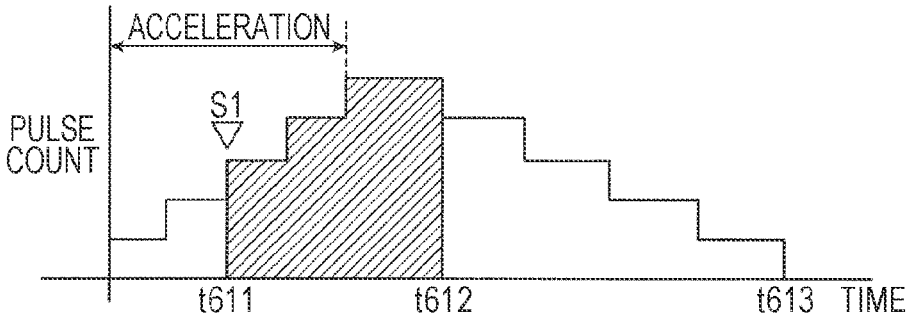
FIGS. 6A and 6B illustrate a relationship between an operational status and a deceleration start timing of the first motor.
Figure 6B:
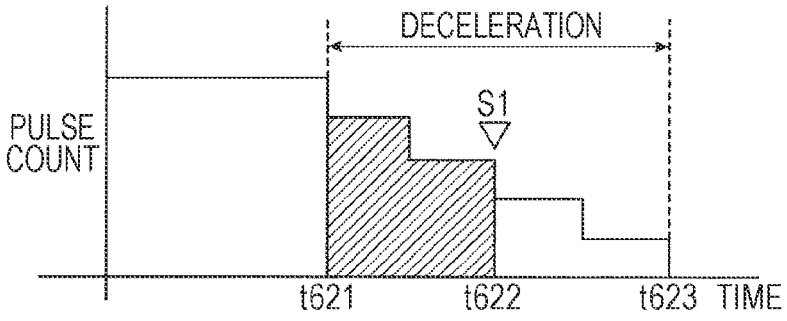

FIGS. 6A and 6B illustrate a relationship between the operational state of the first motor M1 and the deceleration start timing. More specifically, FIG. 6A illustrates an operation example in which the first motor M1 reaches the deceleration start timing during the acceleration period. FIG. 6B illustrates an operation example in which the first motor M1 reaches the deceleration start timing during the deceleration period.

If the first motor M1 reaches the deceleration start timing S1 (at t611) during the acceleration period as illustrated in FIG. 6A, the first motor M1 that is in the middle of an acceleration operation is not able to start a deceleration operation immediately at the arrival at the deceleration start timing S1. More specifically, the first motor M1 accelerates to a constant speed, and then starts decelerating after the completion of the acceleration (at t612).

The deceleration start timing S1 is determined in accordance with the deceleration pulse count DCP that is based on the assumption that the deceleration operation starts from the constant speed state (as illustrated in FIG. 5A). The stop pulse count STP indicating the number of pulses for halting differs from the number of pulses on which the first motor M1 actually halts by the pulse count (hatched portion in FIG. 6A) used from when the first motor M1 reaches the deceleration start timing S1 (at t611) to when the first motor M1 starts decelerating (at t612). More specifically, the first motor M1 halts with a pulse count in excess of the stop pulse count STP.

If the first motor M1 reaches the deceleration start timing S1 (at t622) during the deceleration period as illustrated in FIG. 6B, the first motor M1 already rotates at a speed lower than the constant speed. The number of pulses used by the first motor M1 from the arrival at the deceleration start timing S1 (at t622) to the actual halt of the first motor M1 is smaller than the deceleration pulse count DCP that is based on the assumption that the deceleration operation starts from the constant speed state (as illustrated in FIG. 5A).

The stop pulse count STP indicating the number of pulses for halting differs from the number of pulses on which the first motor M1 actually halts by the pulse count (hatched portion in FIG. 6B) used from when the first motor M1 starts decelerating (at t621) to when the first motor M1 reaches the deceleration start timing S1 (at t622). More specifically, the first motor M1 halts before the stop pulse count STP is reached.

If the first motor M1 halts at a position not corresponding to the stop pulse count STP, the halt position of the paper sheet P transported and driven by the first motor M1 becomes different from an intended position. The paper sheet P may wait on standby prior to the image forming in the exemplary embodiment, and as a result, the length of the paper sheet P cut after halting is subject to variations.

The paper feeder device 100 of the exemplary embodiment includes a plurality of transport modes according to which the paper sheet P is transported. The paper feeder device 100 switches between the transport modes in accordance with the relationship between the operational status of the first motor M1 and the deceleration start timing S1.

More specifically, the relationship between the operational status of the first motor M1 and the deceleration start timing S1 is determined by the specified paper sheet length. In the exemplary embodiment, the transport mode is switched depending on the specified paper sheet length.

The transport modes are specifically described below.

Figure 7:
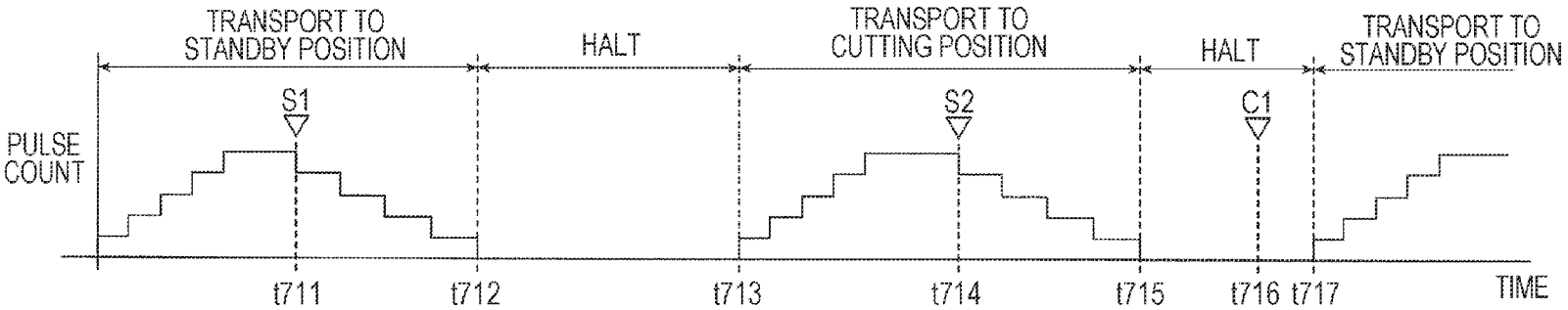
FIG. 7 is a timing diagram illustrating the operation of the first motor in a first transport mode.

A first transport mode is described with reference to FIG. 7. FIG. 7 is a timing diagram illustrating the operation of the first motor M1 in the first transport mode.

When the leading end PL of the paper sheet P reaches the discharge port 27 as a standby position in the first transport mode (a first mode or a first control operation), the third motor M3 is halted, and the first motor M1 is also halted. The first motor M1 then causes the paper sheet P to be transported again and then the paper sheet P is cut.

More specifically, the first motor M1 operates as described below.

After starting to transport the paper sheet P, the first motor M1 starts decelerating at the deceleration start timing S1 (at t711) determined by the timing when the leading end PL reaches the discharge port 27 and then halts (at t712). The paper sheet P loops in the movable transport path 25 because the first motor M1 and the third motor M3 halt at different timings.

The first motor M1 starts transporting the paper sheet P again (at t713) in response to the instruction information from the transport controller 30 that has received the paper feed signal from the image forming controller 60. When the output pulse count OTP monitored by the transport controller 30 reaches the deceleration start pulse count DSP (at a deceleration start timing S2 at t714), the first motor M1 starts decelerating. When the first motor M1 halts (at t715), the ideal cut line of the paper sheet P reaches the cutter 23. In other words, the transport of the paper sheet P to the cutting position is complete. In this state, the cutter 23 cuts the paper sheet P at the ideal cut line (see label C1 at t716). The first motor M1 starts accelerating again to transport the leading end PL of the subsequent paper sheet P (at t717).

Figures 1A, 8:
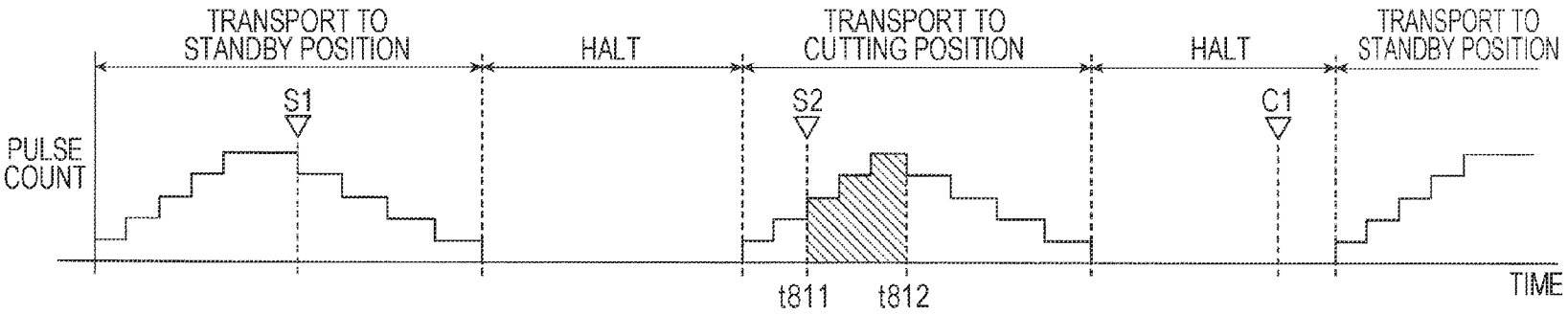
FIGS. 8-1A and 8-1B are timing diagrams illustrating the operation of the first motor in a second transport mode.
Figures 1B, 8:
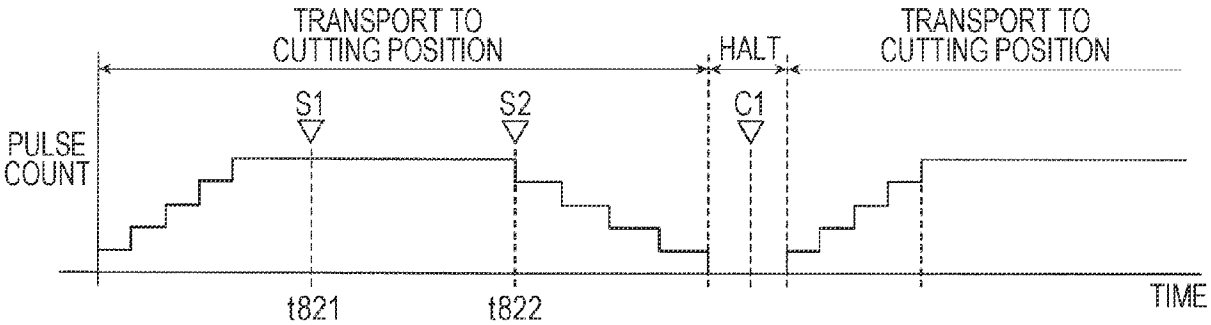
Figures 2A, 8:
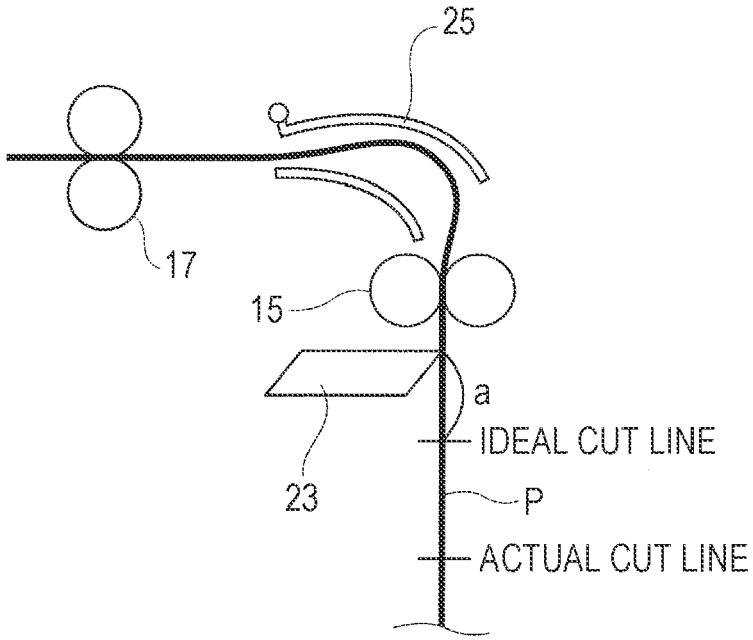
Figures 2B, 8:
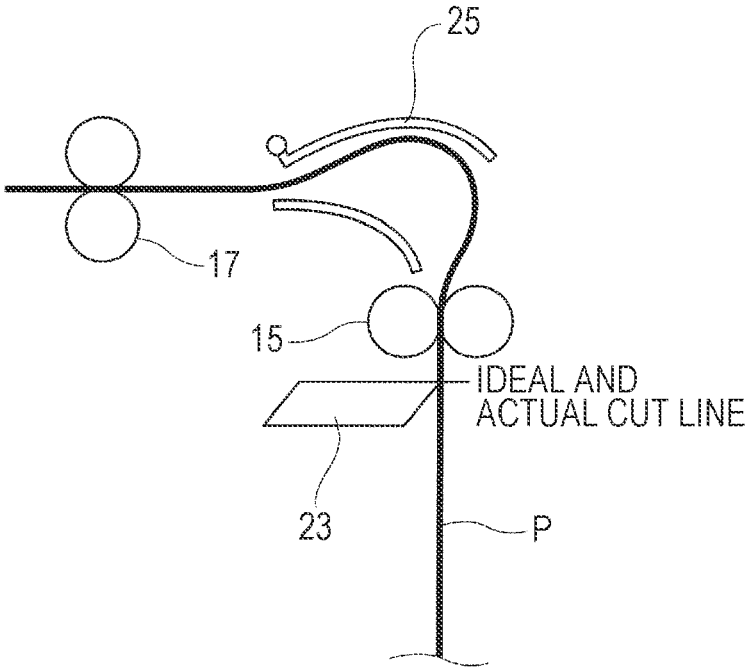

A second transport mode is described with reference to FIGS. 8-1A and 8-1B and 8-2A and 8-2B. FIGS. 8-1A and 8-1B are timing diagrams illustrating the operation of the first motor M1 in the second transport mode. FIGS. 8-2A and 8-2B illustrate the state of the paper sheet P and the cutter 23 during a halt period for the standby state of FIGS. 8-1A and 8-1B.

If the paper sheet P is transported in the first transport mode as in a comparative example illustrated in FIG. 8-1A, the first motor M1 is re-started to move the ideal cut line of the paper sheet P to the cutter 23 after the first motor M1 is once halted (the paper sheet P is thus transported in two phases). Depending on the specified paper sheet length, the output pulse count OTP reaches the deceleration start pulse count DSP (see a deceleration start timing S2 at t811) while the first motor M1 is accelerating.

As described above, the first motor M1 that is unable to immediately start decelerating starts decelerating (at t812) after reaching the constant speed through the acceleration operation, and the stop pulse count STP becomes different from the pulse count on which the first motor M1 halts (hatched portion in FIG. 8-1A). As a result, the paper sheet length of the cut paper sheet P becomes longer than the specified paper sheet length.

If the first motor M1 is re-started after the first motor M1 is halted once as illustrated in FIG. 8-2A, a distance a from the ideal cut line of the halted paper sheet P to the cutter 23 may be so short that the ideal cut line reaches the cutter 23 too soon after the first motor M1 re-starts. In such a case, the halt timing of the first motor M1 is delayed, and an actual cut line where the paper sheet P is actually cut is shifted more backward than the ideal cut line. The distance between the actual cut line and the ideal cut line in FIG. 8-2A corresponds to the hatched portion in FIG. 8-1A.

FIGS. 8-1A and 8-2A illustrate the case in which the distance a between the ideal cut line of the halted paper sheet P and the cutter 23 is shorter than a minimum transport distance of the paper sheet P driven when the first motor M1 starts to rotate and then stops within the shortest possible period of time.

In the second transport mode (a second mode or a second transport control operation), the paper sheet P is transported as illustrated in FIG. 8-1B. In the second transport mode, different from the first transport mode, the first motor M1 is not halted before placing the ideal cut line of the paper sheet P to the cutter 23. The timing (the deceleration start timing S2 at t822) when the first motor M1 actually starts decelerating is delayed from the deceleration start timing S1 (at t821) that is determined by the timing when the leading end PL reaches the discharge port 27. The first motor M1 is thus halted by the stop pulse count STP.

As illustrated in FIG. 8-2B, the first motor M1 is continuously driven in the second transport mode, thereby placing the ideal cut line of the paper sheet P to the cutter 23. This arrangement controls a deviation between the actual cut line and the ideal cut line, and avoids increasing the paper sheet length in excess of the specified paper sheet length. Since the ideal cut line of the paper sheet P is placed at the cutter 23 in advance in the second transport mode, the re-starting of the first motor M1 to place the ideal cut line at the cutter 23 becomes unnecessary. The yield of the device is increased.

The delaying of the timing of the deceleration start of the first motor M1 causes the paper sheet P to be looped. As illustrated in FIG. 8-2B, not only the first motor M1 but also the second motor M2 is driven, causing a loop in the movable transport path 25 larger than a loop in a standard cutting operation.

In comparison with the first transport mode, the second transport mode may vary an amount of loop (curve) formed in the movable transport path 25 in order not to cause the first motor M1 to reach the deceleration start pulse count DSP during the acceleration period or the deceleration period. In the above discussion, the ideal cut line of the paper sheet P is placed at the cutter 23, in other words, the amount of loop is increased more than in the first transport mode. The loop may be absorbed at any location.

Figure 9:
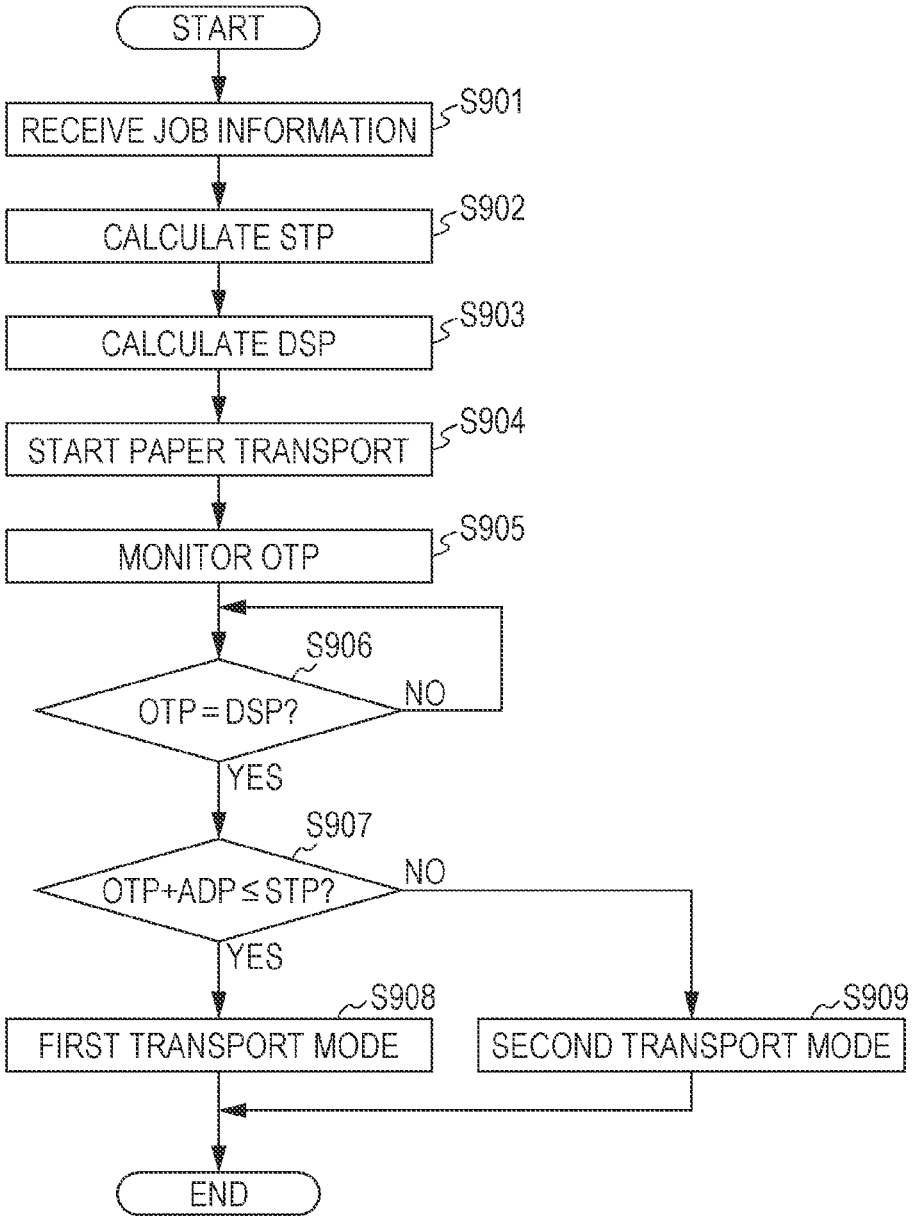
FIG. 9 is a flowchart illustrating a process flow of a transport controller.

A switching operation between the first transport mode and the second transport mode is described with reference to FIG. 9. FIG. 9 is a flowchart illustrating the flow of a process of the transport controller 30.

The transport controller 30 receives from the general controller 90 information containing the specified paper sheet length (step S901).

In response to the specified paper sheet length, the transport controller 30 calculates the stop pulse count STP (step S902) and the deceleration start pulse count DSP (step S903). The first motor M1 is driven, starting to transport the paper sheet P (step S904). The transport controller 30 starts monitoring the output pulse count OTP of the first motor M1 (step S905).

The transport controller 30 then determines whether the output pulse count OTP monitored is equal to the deceleration start pulse count DSP (step S906). If the transport controller 30 determines that the output pulse count OTP monitored is not equal to the deceleration start pulse count DSP (no branch from step S906), the transport controller 30 continues to monitor the output pulse count OTP.

If the output pulse count OTP monitored is equal to the deceleration start pulse count DSP (yes branch from step S906), the transport controller 30 determines whether the sum of the output pulse count OTP and the acceleration and deceleration pulse count ADP is equal to or lower than the stop pulse count STP (step S907). If the sum of the output pulse count OTP and the acceleration and deceleration pulse count ADP is equal to or lower than the stop pulse count STP (yes branch from step S907), the transport controller 30 drives the first motor M1 in the first transport mode (step S908). If the sum of the output pulse count OTP and the acceleration and deceleration pulse count ADP is higher than the stop pulse count STP (no branch from step S907), the transport controller 30 drives the first motor M1 in the second transport mode (step S909).

In the operation example of FIG. 9, the transport controller 30 determines the transport mode to be applied (the first transport mode or the second transport mode) after the paper sheet P begins to be transported. The present invention is not limited to this method. The transport mode to be applied may be determined before the paper sheet P begins to be transported.

If the paper sheet P is to be looped by more than a maximum amount of loop allowed (accommodated) by the movable transport path 25 in the second transport mode (a movable range of the movable plate 251 (FIG. 3A)) before the ideal cut line reaches the cutter 23, the first motor M1 may be operated in the first transport mode.

The first transport mode and the second transport mode may be understood as applicable if the timing of the third motor M3 to halt the leading end PL of the paper sheet P comes before the timing of the first motor M1 to halt the paper sheet P to place the ideal cut line at the cutter 23.

Figure 10:
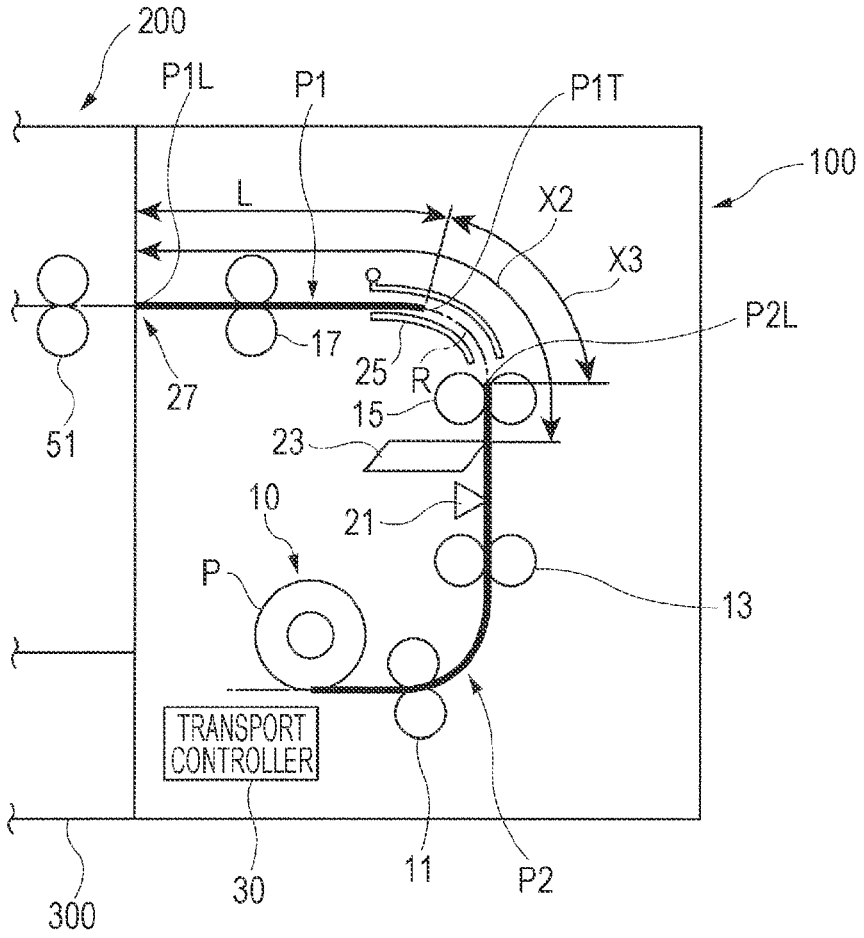
FIG. 10 illustrates a transport state of a short-length paper sheet.

The paper feeder device 100 may transport the paper sheet P shorter in length than the predetermined paper sheet length as illustrated in FIG. 10. FIG. 10 illustrates the state in which a shorter paper sheet is transported.

If the image forming is performed on the paper sheet P having a shorter paper sheet length (such as an A4 sheet arranged in a landscape alignment), plural paper sheets P are concurrently transported from the cutter 23 to the discharge port 27 along the paper transport passage R.

By "plural paper sheets P concurrently transported" is meant that the sum of the paper sheet spacing (paper sheet spacing X3) and the paper sheet length of a preceding paper sheet P1 (length L), or the sum of the specified paper sheet length of the preceding paper sheet P1 and the specified paper sheet length of the subsequent paper sheet P2 is shorter than the distance X2 from the cutter 23 to the discharge port 27.

In other words, by "plural paper sheets P concurrently transported" is meant that the timing of the third motor M3 (FIG. 1) halting the leading end P1L of the preceding paper sheet P1 comes after the timing of the first motor M1 halting the preceding paper sheet P1 to place the ideal cut line at the cutter 23.

As illustrated in FIG. 10, for example, two paper sheets are transported between the cutter 23 and the discharge port 27. As illustrated in FIG. 10, the preceding paper sheet P1 is already cut, but the subsequent paper sheet P2 (the second paper sheet in FIG. 10) is not yet cut. When the leading end P1L of the preceding paper sheet P1 reaches the standby position, the preceding paper sheet P1 is caused to halt and the subsequent paper sheet P2 is also caused to halt to maintain the paper sheet spacing X3 between the preceding paper sheet P1 and the subsequent paper sheet P2.

To supply the paper sheets P having a shorter length in this way, the paper feeder device 100 transports the paper sheets P in a transport mode different from the first and second transport modes.

Third and fourth transport modes different from the first and second transport modes are described below.

Figure 11:
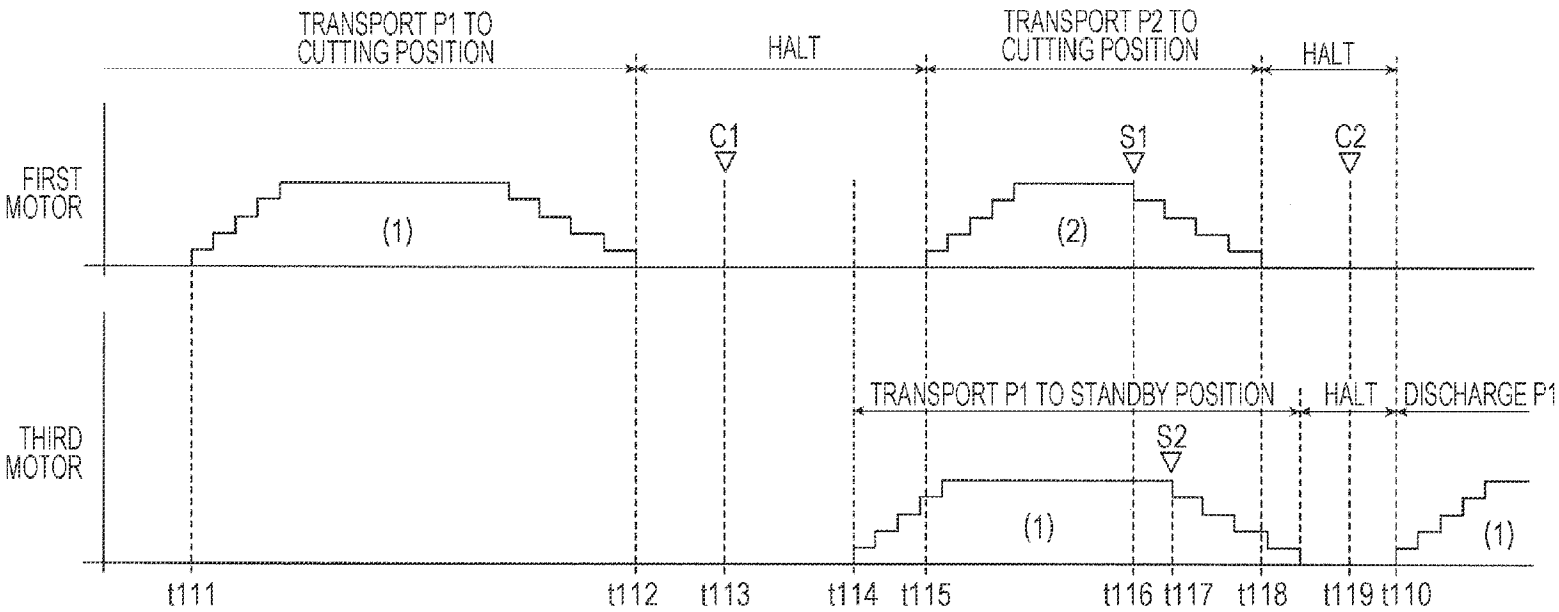
FIG. 11 is a timing diagram illustrating operations of the first and third motors in a third transport mode.

The third transport mode is described below with reference to FIG. 11. FIG. 11 is a timing diagram illustrating the operations of the first motor M1 and the third motor M3 in the third transport mode. In FIG. 11 (and FIGS. 12-1A and 12-1B), the preceding paper sheet P1 is labeled (1), and the subsequent paper sheet P2 is labeled (2).

In the third transport mode (third transport control operation), the preceding paper sheet P1 is transported to the standby position after being cut while the subsequent paper sheet P2 is transported to place the ideal cut line at the cutter 23. The subsequent paper sheet P2 is halted with the ideal cut line aligned with the cutter 23, and then the cutter 23 cuts the subsequent paper sheet P2.

More specifically, the first motor M1 and the third motor M3 operate as described below.

The first motor M1 is driven, starting to transport the preceding paper sheet P1 (at t111). After the second motor M2 is started, the first motor M1 and the second motor M2 are then halted to place the ideal cut line of the preceding paper sheet P1 at the cutter 23 (at t112). In other words, the transport of the preceding paper sheet P1 to the cutting position is complete. In this state, the cutter 23 cuts the preceding paper sheet P1 at the ideal cut line (see label C1 at t113).

The cut preceding paper sheet P1 begins to be transported (at t114) when the third motor M3 (and the second motor M2 as well) are driven. In the exemplary embodiment, the third motor M3 is driven after the paper sheet P is cut. If transport rollers driven by the third motor M3 and the first motor M1 are closed to each other, a loop is formed beforehand, and the third motor M3 is continuously driven so that the loop still remains even after the first motor M1 is halted. The yield of the device is thus increased. After a trailing end P1T of the preceding paper sheet P1 (see FIG. 10) reaches a position of the paper sheet spacing X3 (see FIG. 10) determined by the leading end of P2L of the subsequent paper sheet P2, the first motor M1 is then driven, starting to transport the subsequent paper sheet P2 (at t115).

The first motor M1 starts decelerating when the output pulse count OTP monitored by the transport controller 30 reaches the deceleration start pulse count DSP (see a deceleration start timing S1 at t116). The subsequent paper sheet P2 is halted to place the ideal cut line at the cutter 23 (at t118). In other words, the transport of the subsequent paper sheet P2 to the cutting position is complete. In this condition, the cutter 23 cuts the subsequent paper sheet P2 at the ideal cut line (see label C2 at t119).

The third motor M3 starts decelerating (see the deceleration start timing S2 at t117) and then halts to transport the preceding paper sheet P1 to place the leading end P1L to the standby position. In response to the paper feed signal from the image forming controller 60, the third motor M3 is driven to discharge the preceding paper sheet P1 to the image forming apparatus 200 (at t110).

Figures 1A, 1B, 12:
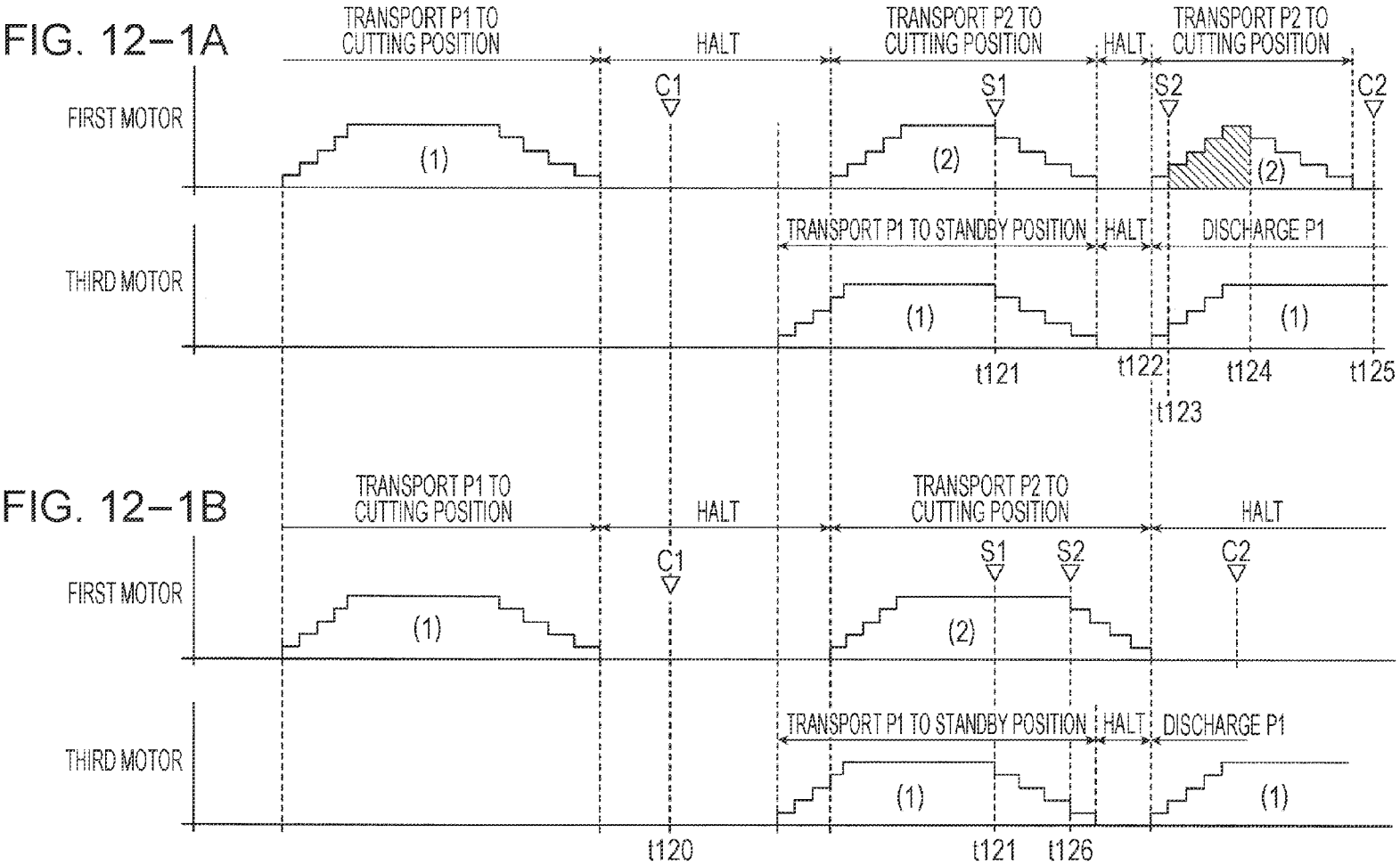
Figures 2A, 12:
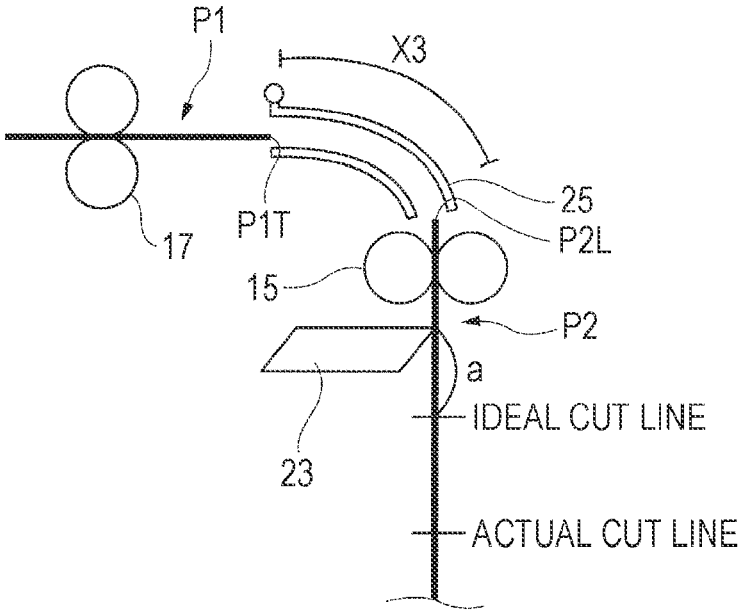
Figures 2B, 12:
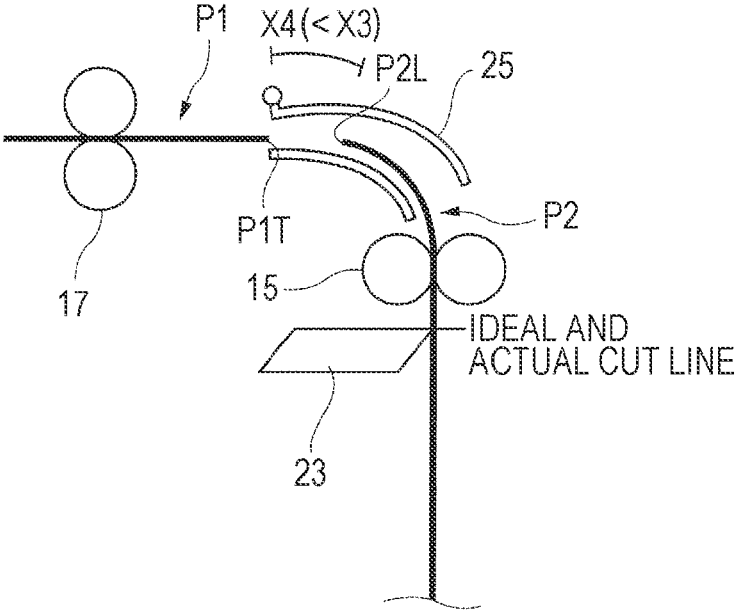

A fourth transport mode is described with reference to FIGS. 12-1A and 12-1B and FIGS. 12-2A and 12-2B. FIGS. 12-1A and 12-1B are timing diagrams illustrating the operations of the first motor M1 and the third motor M3 in the fourth transport mode. FIGS. 12-2A and 12-2B illustrate the paper sheet P and the cutter 23 that are stationary for the standby position of FIGS. 12-1A and 12-1B.

The paper sheet P may be transported in the third transport mode as in a comparative example where the specified paper sheet length falls within the predetermined range illustrated in FIG. 12-1A. When the subsequent paper sheet P2 is transported to the cutter 23 after the preceding paper sheet P1 is cut (at t120), the third motor M3 reaches a deceleration start timing S1 (at t121) to cause the leading end P1L of the preceding paper sheet P1 to reach the standby position. To maintain the paper sheet spacing, the first motor M1 and the third motor M3 together are decelerated (at t121) and then halted.

The preceding paper sheet P1 is freed from the standby state and begins to be transported, and the first motor M1 then begins to transport the subsequent paper sheet P2 again to place the ideal cut line of the subsequent paper sheet P2 at the cutter 23 (at t122). While the first motor M1 is accelerating, the output pulse count OTP of the first motor M1 may reach the deceleration start pulse count DSP (see a deceleration start timing S2 at t123).

Furthermore, if the first motor M1 is re-started after being halted once as illustrated in FIG. 12-2A, the distance a between the ideal cut line of the halted subsequent paper sheet P2 and the cutter 23 may be short. In such a case, the ideal cut line may soon reach the cutter 23 after the first motor M1 is re-started.

As illustrated in FIG. 12-1A, the first motor M1 starts decelerating (at t124) once reaching the constant speed. The stop pulse count STP deviates from the pulse count on which the first motor M1 actually halts (as denoted by a hatched portion). The length of the cut paper sheet P becomes longer than the specified paper sheet length. The distance between the actual cut line and the ideal cut line in FIG. 12-2A corresponds to the hatched portion in FIG. 12-1A.

In the fourth transport mode (fourth transport control operation), the paper sheet P is transported as illustrated in FIG. 12-1B. More specifically, the fourth transport mode is different from the third transport mode in that the first motor M1 is not halted before transporting the cut line of the subsequent paper sheet P2 to the cutter 23. The first motor M1 is thus halted by the stop pulse count STP by delaying the timing when the first motor M1 actually starts decelerating (see the deceleration start timing S2 at t126) after the deceleration start timing S1 (at t121) determined by the timing when the leading end P1L of the preceding paper sheet P1 reaches the discharge port 27.

When the ideal cut line of the subsequent paper sheet P2 is transported to the cutter 23, the paper sheet spacing X4 becomes shorter than the paper sheet spacing X3 as illustrated in FIG. 12-2B. But the paper sheet spacing X4 is still longer than zero, thereby controlling paper jamming caused by touching between the preceding paper sheet P1 and the subsequent paper sheet P2. The paper sheet spacing X3 is an example of a first paper sheet spacing and the paper sheet spacing X4 is a second paper sheet spacing.

In the fourth transport mode, the transport of the leading end P2L of the subsequent paper sheet P2 is halted at the timing when the leading end P1L of the preceding paper sheet P1 reaches the discharge port 27, and the ideal cut line of the subsequent paper sheet P2 is transported in a manner such that the paper sheets P do not overlap each other with the paper sheet spacing X3 maintained. A redundant length of the paper sheet P is absorbed by causing the subsequent paper sheet P2 to curve in a loop in the movable transport path 25 larger than a standard loop.

Figure 13:
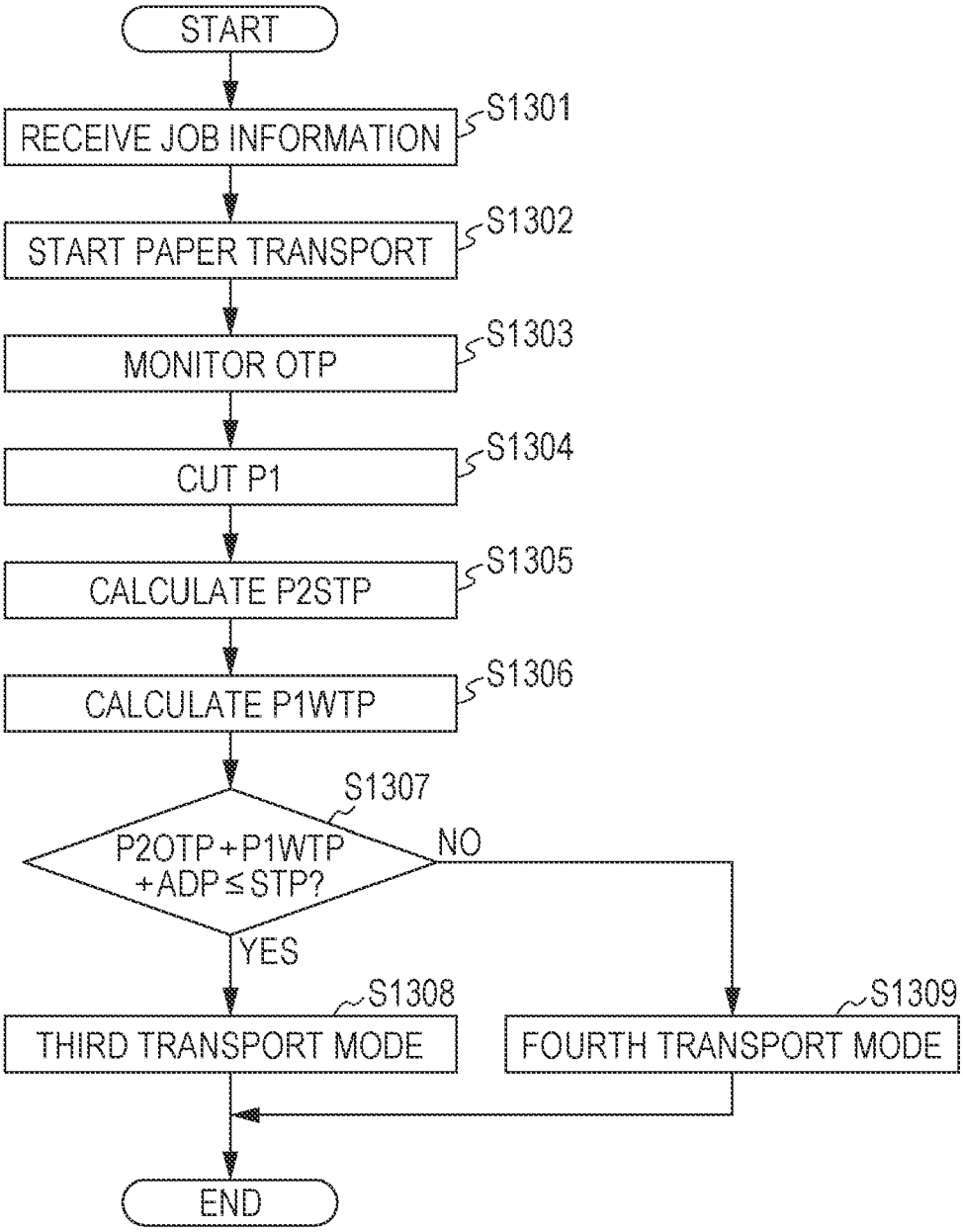
FIG. 13 is a flowchart illustrating a process flow of the transport controller.

A switching operation between the third transport mode and the fourth transport mode is described with reference to FIG. 13. FIG. 13 is a flowchart illustrating a flow of a process of the transport controller 30.

The transport controller 30 first receives the instruction information containing the specified paper sheet length from the general controller 90 (step S1301).

The transport controller 30 drives the first motor M1 to start transporting the paper sheet P (step S1302), and starts monitoring the output pulse counts OTP of the first motor M1 and the third motor M3 (step S1303). The transport controller 30 causes the cutter 23 to cut the preceding paper sheet P1 by the specified paper sheet length (step S1304).

The transport controller 30 calculates the stop pulse count STP of the subsequent paper sheet P2 in accordance with the specified paper sheet length of the subsequent paper sheet P2 (step S1305). The transport controller 30 calculates a predetermined pulse count WTP (=the deceleration start pulse count DSP of the preceding paper sheet P1—the output pulse count OTP of the third motor M3) that is used to place the preceding paper sheet P1 at the standby position in accordance with the specified paper sheet length of the preceding paper sheet P1 (step S1306).

The transport controller 30 determines whether the sum of the output pulse count OTP of the first motor M1, the predetermined pulse count WTP, and the acceleration and deceleration pulse count ADP is equal to or lower than the stop pulse count STP (step S1307). If the sum of the output pulse count OTP of the third motor M3, the predetermined pulse count WTP, and the acceleration and deceleration pulse count ADP is equal to or lower than the stop pulse count STP (yes branch from step S1307), the transport controller 30 causes the first motor M1 to operate in the third transport mode (step S1308). If the sum of the output pulse count OTP of the first motor M1, the predetermined pulse count WTP, and the acceleration and deceleration pulse count ADP is higher than the stop pulse count STP (no branch from step S1307), the transport controller 30 causes the first motor M1 to operate in the fourth transport mode (step S1309).

In the operation example of FIG. 13, the transport controller 30 determines the transport mode to be applied (the third transport mode or the fourth transport mode) after the paper sheet P1 is cut. The present invention is not limited to this method. The transport mode to be applied may be determined before the paper sheet P1 is cut.

In the discussion of the embodiment, the transport controller 30 may switch between the first transport mode and the second transport mode, or may switch between the third transport mode and the fourth transport mode.

For example, the transport controller 30, when placing the ideal cut line of the paper sheet P at the cutter 23, may switch from one transport mode to another if the specified paper sheet length specified in the information from the general controller 90 is equal to or longer than a length L1 over which the first motor M1 reaches the deceleration start pulse count DSP during the acceleration of the first motor M1, if the specified paper sheet length is shorter than the length L1 and equal to or longer than a length L2 that is equal to the length X2 from the cutter 23 to the discharge port 27, if the specified paper sheet length is shorter than the length L2 and equal to or longer than a length L3 over which the first motor M1 reaches the deceleration start pulse count DSP to place the preceding paper sheet P1 at the standby position during the acceleration period of the first motor M1 that transports the subsequent paper sheet P2, or if the specified paper sheet length is shorter than the length L3.

Figure 14:
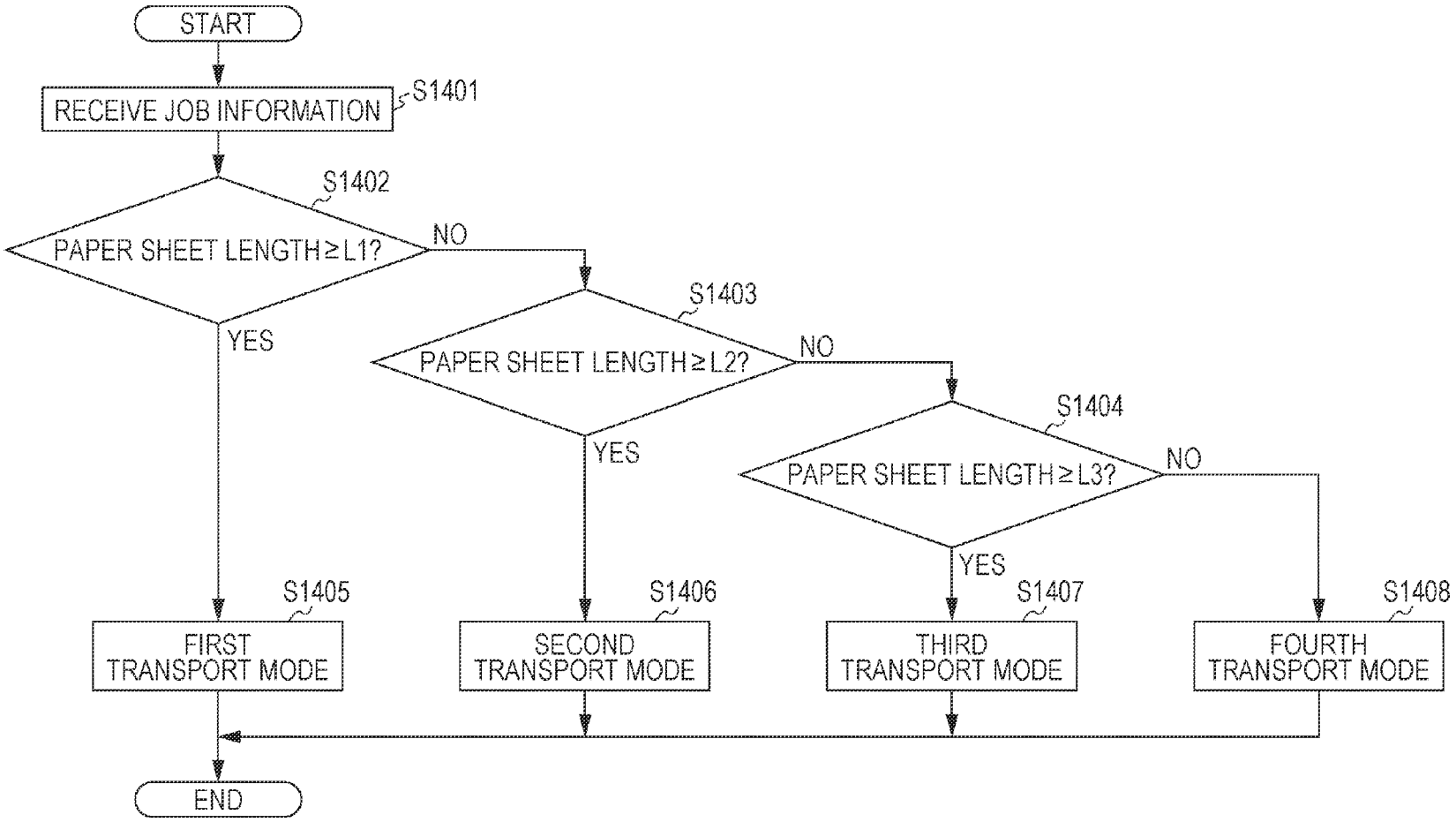
FIG. 14 is a flowchart illustrating a process flow of the transport controller.

More specifically, the transport controller 30 operates as illustrated in FIG. 14. FIG. 14 is a flowchart illustrating a flow of a process of the transport controller 30.

The transport controller 30 receives the instruction information including the paper sheet length from the general controller 90 (step S1401). The transport controller 30 determines whether the paper sheet length is equal to or longer than the length L1 (step S1402). If the paper sheet length is equal to or longer than the length L1 (yes branch from step S1402), the transport controller 30 causes the first motor M1 to operate in the first transport mode (step S1405).

If the paper sheet length is shorter than the length L1 (no branch from step S1402), the transport controller 30 determines whether the paper sheet length is equal to or longer than the length L2 (step S1403). If the paper sheet length is equal to or longer than the length L2 (yes from step S1403), the transport controller 30 causes the first motor M1 to operate in the second transport mode (step S1406).

If the paper sheet length is shorter than the length L2 (no branch from step S1403), the transport controller 30 determines whether the paper sheet length is equal to or longer than the length L3 (step S1404). If the paper sheet length is equal to or longer than the length L3 (yes branch from step S1404), the transport controller 30 causes the first motor M1 to operate in the third transport mode (step S1407). If the paper sheet length is shorter than the length L3 (no branch from step S1404), the transport controller 30 causes the first motor M1 to operate in the fourth transport mode (step S1408).

In the second and fourth transport modes, the deviation between the actual cut line and the ideal cut line is controlled by transporting the paper sheet P to place the ideal cut line to the cutter 23. Optionally, the actual cut line may be placed in advance at a position that is free from a deviation from the ideal cut line and is upstream of the cutter 23 in the transport direction.

Figures 1A, 15:
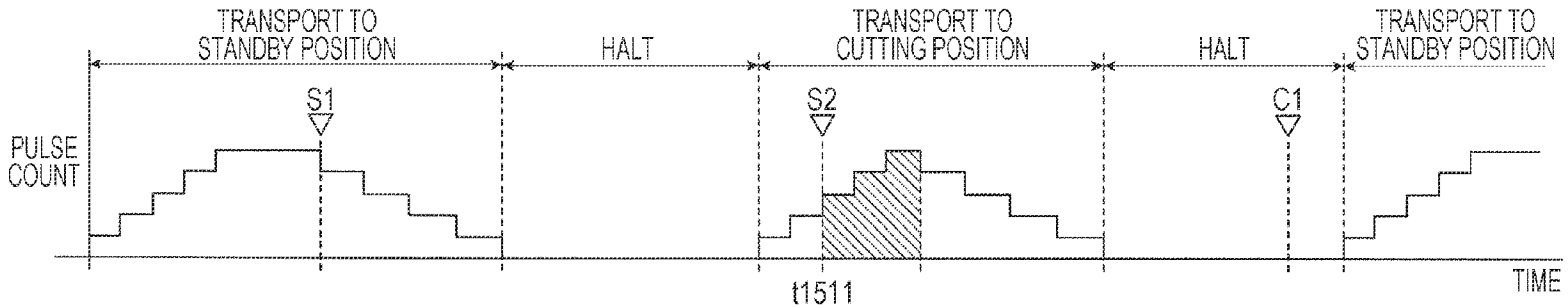
Figures 1B, 15:
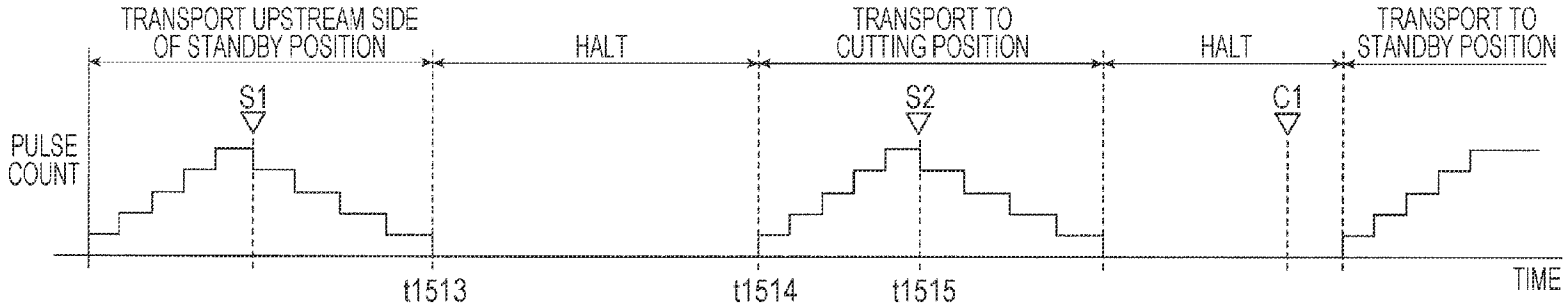
Figures 2A, 15:
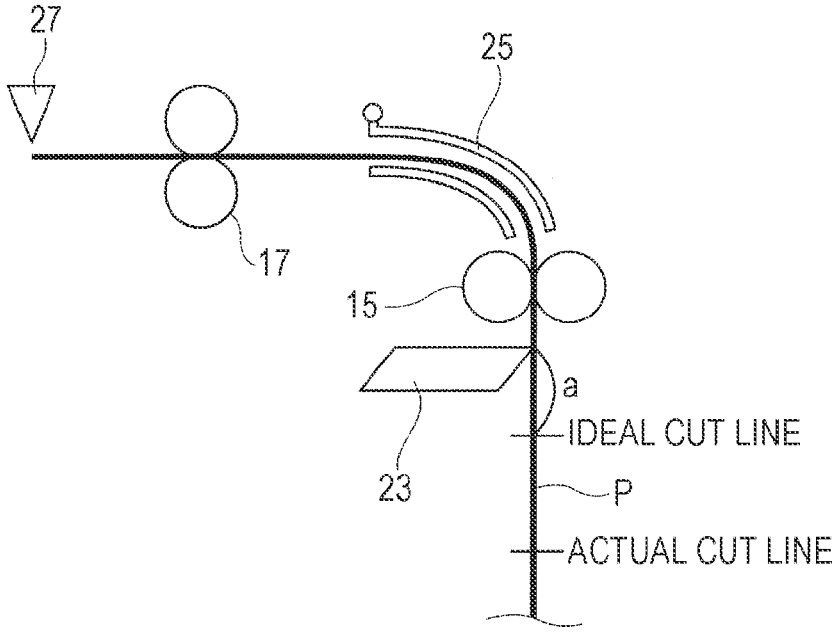
Figures 2B, 15:
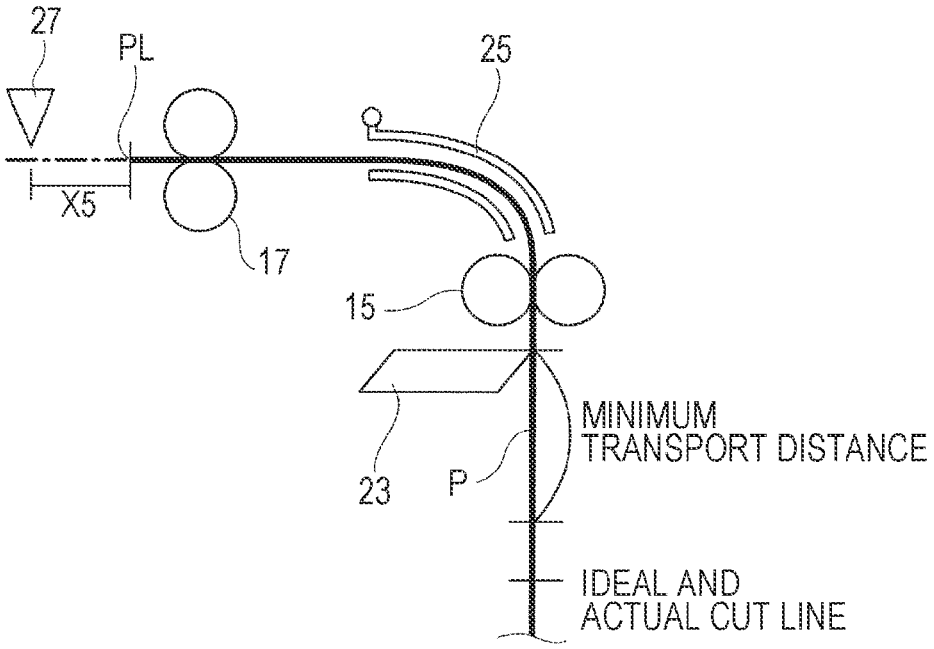

A fifth transport mode as another exemplary embodiment as opposed to the second transport mode is described below with reference to FIGS. 15-1A and 15-1B and FIGS. 15-2A and 15-2B. FIGS. 15-1A and 15-1B are timing diagrams illustrating the operation of the first motor M1 in the fifth transport mode. FIGS. 15-2A and 15-2B illustrate the paper sheet P and the cutter 23 that are stationary for the standby position of FIGS. 15-1A and 15-1B.

If the output pulse count OTP reaches the deceleration start pulse count DSP (see a deceleration start timing S2 at t1511) while the first motor M1 is accelerating as illustrated in a comparative example of FIG. 15-1A, the actual cut line of the paper sheet P is shifted backward from the ideal cut line and the length of the cut paper sheet P becomes longer than the specified paper sheet length as illustrated in FIG. 15-2A.

In this exemplary embodiment, the paper sheet P is transported as illustrated in FIG. 15-1B. More specifically, the paper sheet P is transported to halt the leading end PL upstream of the discharge port 27 (at t1513) instead of placing the leading end PL at the discharge port 27 as the standby position. In other words, the paper sheet P is halted once at a position behind the standby position (see a distance X5 of FIG. 15-2B).

The first motor M1 then starts transporting the paper sheet P again (at t1514) in response to the instruction information from the transport controller 30 that has received the paper feed signal from the image forming controller 60. Once reaching the constant speed, the first motor M1 starts decelerating when the output pulse count OTP reaches the deceleration start pulse count DSP (see a deceleration start timing S2 at t1515).

If the first motor M1 is driven and then halted for the shortest period of time as illustrated in FIG. 15-2B in this exemplary embodiment, the distance between the ideal cut line and the cutter 23 is set not to be shorter than a minimum transport distance over which the paper sheet P is transported from the start of the first motor M1. In this way, this arrangement controls the deviation between the actual cut line and the ideal cut line, and avoids lengthening the paper sheet in excess of the specified paper sheet length.

A sixth transport mode as opposed to the fourth transport mode is described below with reference to FIGS. 16-1A, 16-1B, and 16-1C and FIGS. 16-2A, 16-2B, and 16-2C. FIGS. 16-1A, 16-1B, and 16-1C are timing diagrams illustrating the operations of the first motor M1 and the third motor M3 in the sixth transport mode. FIGS. 16-2A, 16-2B, and 16-2C illustrate the paper sheet P and the cutter 23 that are stationary for the standby position of FIGS. 16-1A, 16-1B, and 16-1C.

Figures 1A, 1B, 1C, 16:
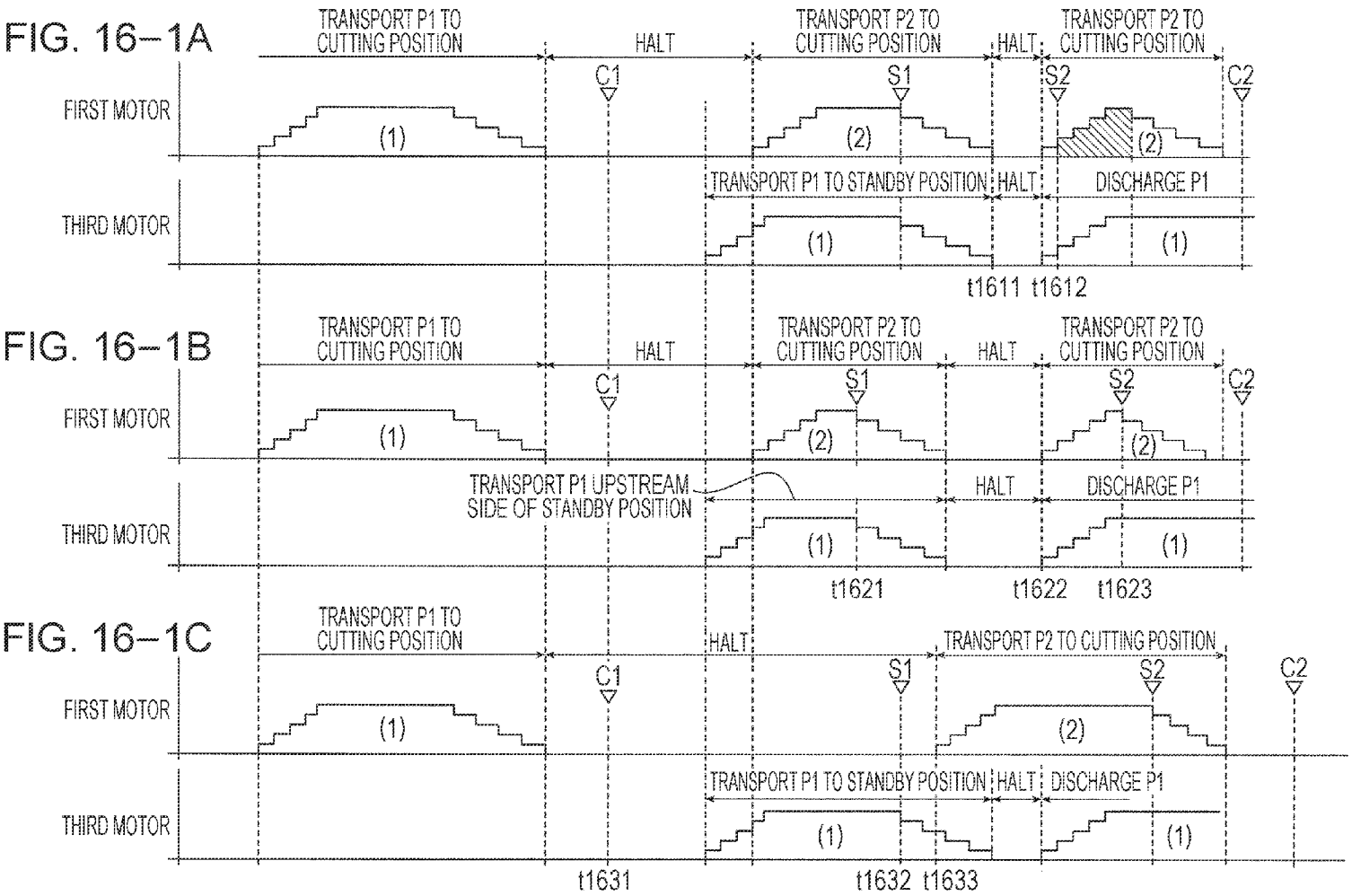
Figures 2A, 16:
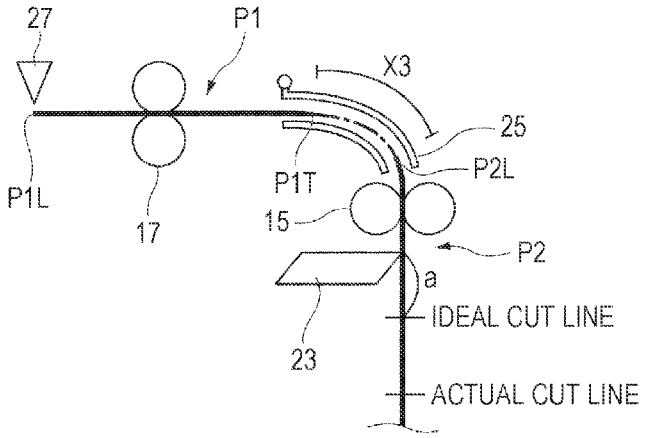
Figures 2B, 16:
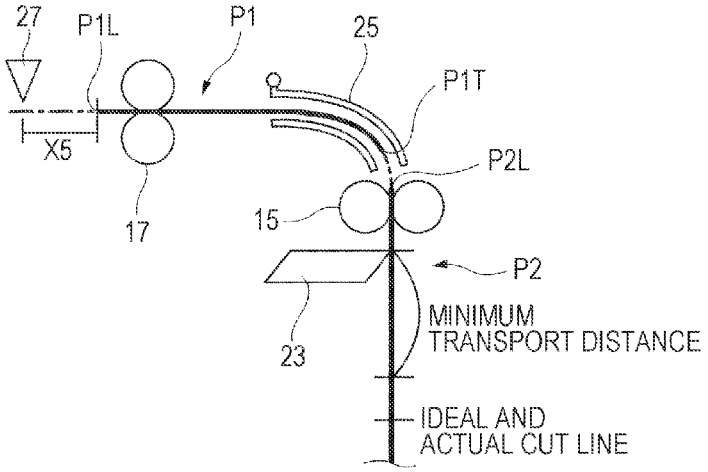
Figures 2C, 16:
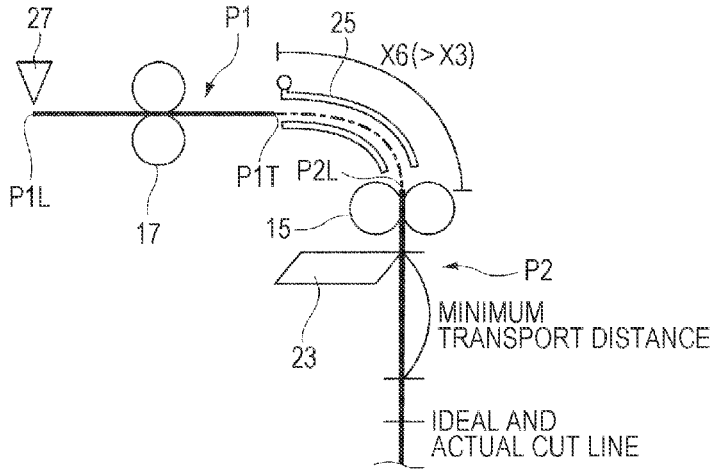

The output pulse count OTP may reach the deceleration start pulse count DSP (see a deceleration start timing S2 at t1612) while the first motor M1 is accelerating after once being halted (at t1611) as illustrated in a comparative example of FIG. 16-1A when the third motor M3 transports the leading end P1L of the preceding paper sheet P1 to the standby position. In such a case, the actual cut line of the paper sheet P is shifted backward from the ideal cut line and the length of the cut paper sheet P becomes longer than the specified paper sheet length as illustrated in FIG. 16-2A.

In this exemplary embodiment, the paper sheet P is transported as illustrated in FIG. 16-1B. More specifically, the preceding paper sheet P1 is transported to halt the leading end P1L upstream of the discharge port 27 (at t1621) instead of placing the leading end P1L at the discharge port 27. In other words, the paper sheet P1 is halted once at a position behind the standby position (see a distance X5 of FIG. 16-2B). The first motor M1 transporting the paper sheet P2 is also halted to keep the paper sheet spacing X3 between the preceding paper sheet P1 and the subsequent paper sheet P2.

The first motor M1 then starts transporting the paper sheet P2 again (at t1622). Once reaching the constant speed, the first motor M1 starts decelerating when the output pulse count OTP reaches the deceleration start pulse count DSP (see a deceleration start timing S2 at t1623).

As illustrated in FIG. 16-2B in this exemplary embodiment, the distance between the ideal cut line of the subsequent paper sheet P2 and the cutter 23 is set not to be shorter than the minimum transport distance of the first motor M1. This arrangement controls the deviation between the actual cut line and the ideal cut line, and avoids lengthening the paper sheet in excess of the specified paper sheet length.

In yet another exemplary embodiment, the paper sheet P is transported as illustrated in FIG. 16-1C. In comparison with the case of FIG. 16-1A, a transport start timing to transport the ideal cut line of the subsequent paper sheet P2 to the cutter 23 is delayed after the cutting of the preceding paper sheet P1 (at t1631). More specifically, a distance between the preceding paper sheet P1 and the subsequent paper sheet P2 is increased to a paper sheet spacing X6.

In the illustrated examples, the transport of the subsequent paper sheet P2 starts (at t1633) after the third motor M3 reaches the deceleration start timing S1 to transport the leading end P1L of the preceding paper sheet P1 to the standby position (at t1632). This arrangement controls the lengthening of the subsequent paper sheet P2 in excess of the specified paper sheet length.

Figure 17A:
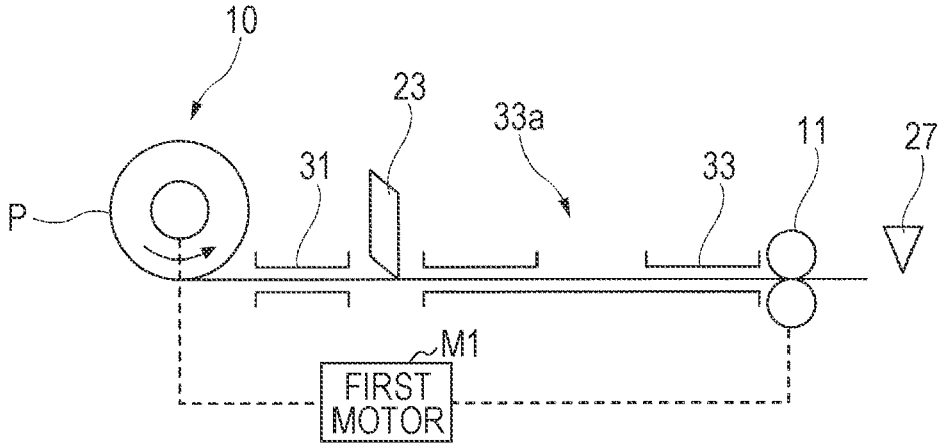
FIGS. 17A and 17B diagrammatically illustrate a modification of the exemplary embodiment.
Figure 17B:
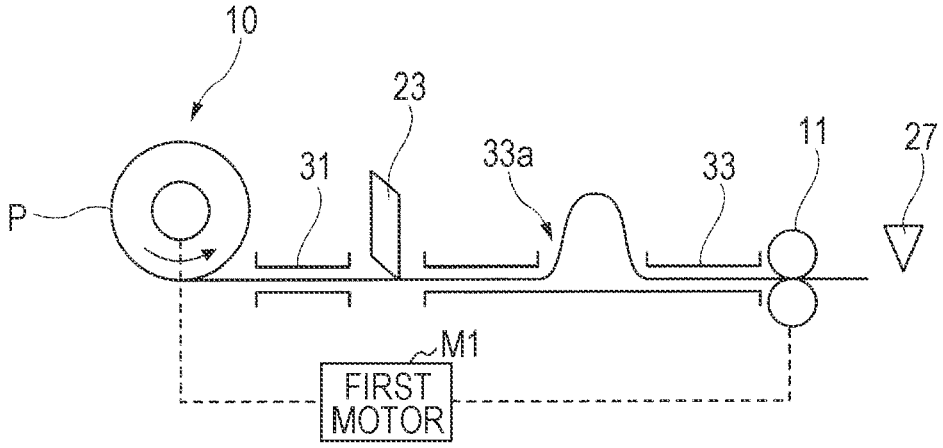

Modifications of the exemplary embodiments are described with reference to FIGS. 17A and 17B. FIGS. 17A and 17B diagrammatically illustrate the modifications.

In the above discussion, the first motor M1, the second motor M2, and the third motor M3 are used to form a loop on the paper sheet P in response a difference between the speeds thereof. However, the second motor M2 is not necessarily used, and the structure without the second motor M2 is also acceptable.

As illustrated in FIGS. 17A and 17B, only the first motor M1 is arranged and a clutch may be used to turn on and off to form a loop on the paper sheet P. As illustrated in FIGS. 17A and 17B, the first motor M1 drives the feeder unit 10 and the first rollers 11 arranged downstream of the feeder unit 10 in the transport direction.

In the above discussion, the movable transport path 25 is arranged. The transport passage is not limited to any particular structure as long as the transport passage provides a space along the paper transport passage R that permits the paper sheet P to be looped. For example, a first paper transport path 31 and a second paper transport path 33 with the cutter 23 interposed therebetween are arranged to transport the paper sheet P. One side surface of the second paper transport path may include an opening 33*a*, and the paper sheet P is allowed to be looped in the opening 33*a*. If the first rollers 11 are arranged upstream of the opening 33*a* in the paper transport direction, and downstream of the cutter 23 of the paper sheet P in the paper transport direction, the looping of the paper sheet P facing the cutter 23 is controlled.

As illustrated in FIGS. 8-1A and 8-1B, and 12-1A and 12-1B, a long length of the trailing portion of the paper sheet P is transported toward the cutter 23. The standby position is at the discharge port 27 in the above discussion. Alternatively, the standby position may be set up upstream of the discharge port 27 in the paper transport direction. If the paper sheet length is shorter than a threshold length, the leading end PL of the paper sheet P may be transported downstream of the standby position in the paper transport direction without projecting the leading end PL out of the discharge port 27.

In the above discussion, the paper sheet P is transported by halting the first motor M1, and the second motor M2 after the third motor M3. Alternatively, the first motor M1, the second motor M2, and the third motor M3 may be concurrently halted by causing the first motor M1 and the second motor M2 relatively upstream of the third motor M3 to rotate faster than the third motor M3.

In the above discussion, the stepping motor is used. Another type of motor, such as a direct current (DC) motor, may also be used. In such a case, experiments may be conducted to determine how much more the motor rotates by inertia when the DC motor is turned to off from on, and the threshold length may be determined in view of the experiment results.

In the above discussion, one of the first through fourth transport modes is applied to drive the first motor M1. Alternatively, the paper transport mode may be switched depending on the paper sheet P. For example, the first transport mode or the second transport mode is applied to the preceding paper sheet P1, and the third transport mode or the fourth transport mode is applied to the subsequent paper sheet P2. In another example, the first transport mode or the second transport mode is applied to the preceding paper sheet P1, and the third transport mode or the sixth transport mode is applied to the subsequent paper sheet P2. The transport mode may be switched on a per paper sheet P basis. In such a case, the paper sheet P may be on the standby position with a minimum possible margin, and the paper sheet spacing is still kept.

In the above discussion, the operation of the first motor M1 has been described. Alternatively, the first transport mode through the fourth transport mode may be applied to the second motor M2.

The exemplary embodiment is applicable if the preceding paper sheet P1 and the subsequent paper sheet P2 are different in specified paper sheet length.

In the above discussion, the paper feeder device 100 starts feeding the paper sheet P in response to the instruction information from the image forming controller 60 in the image forming apparatus 200. The present embodiment is not limited to this method. The present exemplary embodiment is also applicable in an arrangement in which the paper feeder device 100 starts feeding the paper sheet P after the leading end PL of the paper sheet P is halted. For example, the present exemplary embodiment is applicable in an arrangement where the paper feeding starts in response to paper feed instruction information from a post-processing apparatus that performs a binding process on the paper sheet P.

The present exemplary embodiment is also applicable when the subsequent paper sheet P2 to be cut next waits on standby if the preceding paper sheet P1 suffers from paper jamming. In this case, jamming of the preceding paper sheet P1 is detected, and the subsequent paper sheet P2 is halted. If the ideal cut line is too close to the cutter 23, the subsequent paper sheet P2 is halted after the general controller 90 transports the ideal cut line to the cutter 23. After the jammed preceding paper sheet P1 is removed, image forming is performed on the subsequent paper sheet P2. If the preceding paper sheet P1 and the subsequent paper sheet P2 have the same paper sheet length, an image to be formed on the preceding paper sheet P1 that has been jammed may be formed on the subsequent paper sheet P2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a transport unit configured to transport a paper sheet;

a cutter unit configured to cut the paper sheet; and a controller configured to, when transport of the paper sheet in the vicinity of the cutter unit is to be halted, control the transport unit so that the transport unit transports the paper sheet by a longer travel when a specified length of the paper sheet is shorter than a threshold length than when the specified length of the paper sheet is longer than the threshold length, wherein the cutter unit is configured to cut the paper sheet, transported by the transport unit, at the ideal cut line where a resulting cut sheet has the specified length, wherein the transport unit comprises:

a first transport section configured to transport the paper sheet and then halt the transport of the paper sheet so that the ideal cut line is placed at the cutter unit; and a second transport section configured to transport the paper sheet downstream of the cutter unit in a direction of transport, and halt the transport of the leading end of the paper sheet at a standby position if the leading end of the paper is to remain on standby, and wherein the controller is configured to switch between a first transport control operation and a second transport control operation, wherein the controller is configured to, in the first transport control operation, if a timing of the second transport section causing the leading end of the paper sheet to halt comes before a timing of the first transport section causing the paper sheet to halt to place the ideal cut line at the cutter unit, control the second transport section to cause the leading end to halt in accordance with the length of the paper sheet while controlling the first transports to cause the paper sheet to halt before the ideal cut line reaches the cutter unit, and wherein the controller is configured to, in the second transport control operation, control the second transport section to cause the leading end to halt while controlling the first transport section to transport the paper sheet until the cut line reaches the cutter unit and then control the transport of the paper sheet to halt.

2. The transport device according to claim 1, wherein the controller is configured to shift to the second transport operation at a timing of starting deceleration of a transport speed of the paper sheet in the course of adjusting the speed of the paper sheet after the first transport section causes the paper sheet to halt once before the ideal cut line reaches the cutter unit in the first transport operation.

3. The transport device according to claim 1, further comprising an accommodating unit that accommodates curving of the paper sheet occurring in a paper transport path between the cutter unit and the standby position.

4. The transport device according to claim 3, wherein the controller is configured to control the transport unit to transport the paper sheet in the first transport control operation if the transport of the paper sheet in the second transport operation would cause the paper sheet to curve to a maximum of curving accommodated by the accommodating unit or more before the ideal cut line reaches the cutter unit.

5. The transport device according to claim 1, wherein the transport unit comprises a stepping motor as a driving source; and wherein the controller is configured to shift to the second transport operation at a timing of the first transport section starting deceleration of a transport speed of the paper sheet to cause the ideal cut line to reach the cutter unit while the stepping motor accelerates after the first transport section causes the paper sheet to halt once while the second transport section halts the leading end in the first transport control operation.

6. The transport device according to claim 1, wherein the controller is configured to switch between a third transport control operation and a fourth transport control operation, wherein the controller is configured to, in the third transport control operation, if a timing of the second transport section causing the leading end of the paper sheet to halt comes after a timing of the first transport section causing the paper sheet to halt to place the ideal cut line at the cutter unit, control the second transport section to cause a leading paper sheet cut by the cutter unit and transported by the first transport section to halt in accordance with the length of the paper sheet, and control the first transport section to transport the leading paper sheet and a subsequent paper sheet in succession to the cut leading paper sheet with a first paper sheet spacing therebetween, and wherein the controller is configured to, in the fourth transport control operation, control the second transport section to halt the transport of the leading paper sheet and control the first transport section to transport the subsequent paper sheet together with the leading paper sheet with a second paper sheet spacing therebetween different from the first paper sheet spacing.

7. An image forming apparatus comprising:

the transport device of claim 1; and an image forming unit configured to form an image on the paper sheet transported by the transport unit.

8. A transport device comprising:

a transport unit configured to transport a paper sheet;

a cutter unit configured to cut the paper sheet; and a controller configured to, when transport of the paper sheet in the vicinity of the cutter unit is to be halted, control the transport unit so that the transport unit transports the paper sheet by a longer travel when a specified length of the paper sheet is shorter than a threshold length than when the specified length of the paper sheet is longer than the threshold length, wherein the controller is configured to switch between a first mode performed when a length of the paper sheet is longer than the threshold length and a second mode performed when the length of the paper sheet is shorter than the threshold length, wherein the controller is configured to cause, in the first mode, an ideal cut line corresponding to the length of the paper sheet to be halted when a leading end of the paper sheet is halted, and wherein the controller is configured to, in the second mode, transport the ideal cut line to the cutter unit while the leading end of the paper sheet remains halted.

9. A transport method comprising:

transporting a paper sheet;

cutting the paper sheet by a cutter unit; and when transport of the paper sheet in the vicinity of the cutter unit is to be halted, controlling the transport of the paper sheet so that the paper sheet is transported by a longer travel when a specified length of the paper sheet is shorter than a threshold length than when the specified length of the paper sheet is longer than the threshold length, wherein the cutting comprises cutting the paper sheet, transported by the transport unit, at the ideal cut line where a resulting cut sheet has the specified length, wherein the transporting comprises:

transporting, by a first transport section, the paper sheet and then halting the transport of the paper sheet so that the ideal cut line is placed at the cutter unit; and transporting, by a second transport section, the paper sheet downstream of the cutter unit in a direction of transport, and halting the transport of the leading end of the paper sheet at a standby position if the leading end of the paper is to remain on standby, and wherein the controlling the transport of the paper sheet comprises switching between a first transport control operation and a second transport control operation, wherein the first transport control operation comprises, if a timing of the second transport section causing the leading end of the paper sheet to halt comes before a timing of the first transport section causing the paper sheet to halt to place the ideal cut line at the cutter unit, then controlling the second transport section to cause the leading end to halt in accordance with the length of the paper sheet while controlling the first transport section to cause the paper sheet to halt before the ideal cut line reaches the cutter unit, and wherein the second transport control operation comprises controlling the second transport section to cause the leading end to halt while controlling the first transport section to transport the paper sheet until the cut line reaches the cutter unit and then controlling the transport of the paper sheet to halt.

10. An image forming method comprising:

the transport method of claim 9; and forming an image on the transported paper sheet.

11. A transport method comprising:

transporting a paper sheet;

cutting the paper sheet by a cutter unit; and when transport of the paper sheet in the vicinity of the cutter unit is to be halted, controlling the transport of the paper sheet so that the paper sheet is transported by a longer travel when a specified length of the paper sheet is shorter than a threshold length than when the specified length of the paper sheet is longer than the threshold length, wherein the controlling the transport of the paper sheet comprises switching between a first mode performed when a length of the paper sheet is longer than the threshold length and a second mode performed when the length of the paper sheet is shorter than the threshold length, wherein the controlling the transport of the paper sheet comprises causing, in the first mode, an ideal cut line corresponding to the length of the paper sheet to be halted when a leading end of the paper sheet is halted, and wherein the controlling the transport of the paper sheet comprises, in the second mode, transporting the ideal cut line to the cutter unit while the leading end of the paper sheet remains halted.

* * * * *